United States Patent [19]

Hubert et al.

[11] Patent Number: 4,912,943

[45] Date of Patent: Apr. 3, 1990

[54] METHOD AND APPARATUS FOR ENHANCING PRODUCTION CAPACITY AND FLEXIBILITY OF A MULTI-TIER REFRIGERATION TUNNEL

[75] Inventors: Jean-Luc Hubert, Willowbrook; Miles S. Bajcar, Palo Hills, both of Ill.

[73] Assignee: Liquid Air Corporation, Walnut Creek, Calif.

[21] Appl. No.: 284,421

[22] Filed: Dec. 14, 1988

[51] Int. Cl.[4] ..... F25D 17/02

[52] U.S. Cl. ..... 62/374; 62/63; 62/380

[58] Field of Search ..... 62/63, 374, 380

[56] References Cited

U.S. PATENT DOCUMENTS

| | | | |
|---|---|---|---|
| 2,677,943 | 5/1954 | Nelson et al. | 62/380 |
| 3,605,434 | 9/1971 | Boese | 62/380 |
| 3,708,995 | 1/1973 | Berg | 62/63 |
| 3,813,895 | 6/1974 | Klee et al. | 62/266 |
| 3,841,109 | 10/1974 | Cann | 62/266 |
| 3,879,954 | 4/1975 | Cann | 62/63 |
| 3,892,104 | 7/1975 | Klee et al. | 62/186 |
| 4,481,782 | 11/1984 | Mukerjee | 62/63 |
| 4,580,413 | 4/1986 | Klee | 62/380 |
| 4,757,691 | 7/1988 | Compagnon | 62/63 |

OTHER PUBLICATIONS

Koach Freezing Systems–Liquid Nitrogen Immersion–Plus Freezers.

*Primary Examiner*—Ronald C. Capossela
*Attorney, Agent, or Firm*—Oblon, Spivak, McClelland, Maier & Neustadt

[57] ABSTRACT

A multi-tier refrigeration tunnel of modular construction, with lateral doors, in which fans are disposed between each tier, in which they are driven by shafts extending from ceiling to floor of the tunnel, and in which the shafts are driven by top mounted fan motors. A multi tier refrigeration tunnel, not of modular construction and without lateral doors, in which fans are disposed between each tier, in which the fans are driven by shafts extending from the floor of the tunnel and from the ceiling of the tunnel, in which the shafts are driven by top mounted and bottom mounted fan motors. A multi tier refrigeration tunnel, and by extension also a single tier refrigeration tunnel, in which two products of different required processing times can be processed simultaneously. A multi tier refrigeration tunnel, preferably without lateral doors but not necessarily, in which fans are disposed above the upper tier and in which fans are disposed next to, and to the side of, the lower tiers.

35 Claims, 14 Drawing Sheets

METHOD AND APPARATUS FOR ENHANCING PRODUCTION CAPACITY AND FLEXIBILITY OF A MULTI-TIER REFRIGERATION TUNNEL

FIELD OF THE INVENTION:

The present invention relates to a multi-tier linear refrigeration tunnels of known designs for cooling and/or chilling and/or crust freezing and/or freezing various products using a refrigeration source which may be a liquid cryogen such as carbon dioxide or nitrogen or air or another suitable liquid cryogen or which may be a refrigerated gas such as air or other suitable gases.

BACKGROUND OF THE INVENTION:

Linear refrigeration tunnels of this general type are widely known and are sold commercially as, e.g., Cardox ULTRAFREEZE®, L'Air Liquide ZIPFREEZE®, Koach IMMERSION PLUS™, Agefko Mehrlagentunnel CFM™, and Rommenholler ETAGENFROSTER TE™.

Known multi-tier linear refrigeration tunnels are typically composed of an insulated enclosure through which the various products to be refrigerated are transported by two or more, but typically three, parallel and superposed stainless steel or food grade plastic endless conveyor belts of selected width from an entry end to an exit end.

The known linear refrigeration tunnels may be of modular construction (i.e., the equipment may be composed of two or more adjacent and connected modular sections forming the previously described insulated enclosure). Such modular construction enables simple installation and simple size increase or decrease. Because such modular construction usually provides modular sections with horizontally hinged side doors that can be opened either manually (e.g., in the ULTRAFREEZE®device disclosed in U.S. Pat. Nos. 3,841,109 and 3,879,954) or hydraulically (e.g., in the devices disclosed in U.S. Pat. Nos. 4,580,413; 3,813,895; and 3,892,104), the modular construction enables simple and thorough washdown (because there are no hidden corners), easy and quick access to desired locations, and fast solutions to production incidents provided some basic safety mechanisms are installed, as they typically are.

Linear refrigeration tunnels may also be of nonmodular construction — i.e., they are available in a few different sizes as set by the manufacture. Typically, such equipment is composed of one flat bottom insulation panel on which an upper U-shaped insulation wall rests during production. For washdowns, troubleshooting, and solutions to production incidents, the entire upper insulation is hydraulically raised. Typically, the raising operation is only possible when the equipment has warmed up. The disadvantages of the lack of modularity are obvious from contrasting the descriptions of the advantages of modularity in the previous paragraph. The advantage of lack of modularity is a usually lower manufacturing cost.

The known refrigeration tunnels achieve a refrigeration effect by creating a temperature driving force field by maintaining a given temperature level or profile in the cold gas atmosphere of the enclosure (using the previously mentioned refrigeration sources and suitable refrigeration medium delivery apparatus) and by creating a heat transfer coefficient field (by blowing cold gas on the surface of the products to be refrigerated using fans or other suitable means, by blowing cold gas jets on the surfaces of the products using the kinetic energy from the expansion of a high pressure liquid cryogen such as carbon dioxide, or by depositing the condensed phase of a liquid cryogen on the surface of the products using nozzles or other suitable means, but typically by fans or other suitable circulation means possibly combined with nozzles or other suitable injection means).

Since the production capacity, for a given usable belt area and for a given product, is directly dependent on the surfacic heat flux (which is the temperature driving force times the heat transfer coefficient — i.e., $\phi=h(Tw=Ta)$), optimizing production capacity requires (1) optimizing the temperature driving force through maintaining the lowest possible temperature within the enclosure and (2) optimizing the heat transfer coefficient, but under the constraint that the efficiency of the process be as high as possible. Due to that constraint, temperatures within the insulated enclosures of tunnels using liquid cryogens are usually regulated above their lowest possible levels (i.e., the saturation temperature of the cryogens at atmospheric pressure) in order to avoid accumulation of the condensed phase of the cryogens, and, if applicable, to make use of the sensible heat of the vaporized cryogens. Due to that constraint, the number of nozzles is limited to a certain maximum number which is a function of nozzle characteristics and of freezer characteristics.

Due to the above listed limitations on temperature levels within the freezer enclosure and on the use of liquid cryogen injection nozzles, optimizing the production capacity of the refrigeration tunnels requires optimizing the flow created by the fans.

The prior art shows two types of ventilation in multi-tier linear refrigeration tunnels. One type (shown in U.S. Pat. Nos. 3,841,109; 3,879,954; and 3,892,104) is directly derived from the single-tier linear refrigeration tunnel technology which uses top-mounted fan motors driving horizontal fan propellers located above the upper tier to circulate the cold gas within the enclosure. The other type (e.g., L'Air Liquide ZIPFREEZE® three-tier refrigerators and the device disclosed in U.S. Pat. No. 3,708,995) broke away from the single tier linear freezer technology and use side-mounted fan motors driving vertical fan propellers located between the tier assembly and the lateral walls of the tunnel (instead of top-mounted fans) to circulate the cold gas.

The known types of multi-tier linear refrigeration tunnels simultaneously exhibited advantages and drawbacks.

The top-mounted fans version ensures a very high, nearly uniform (with blades of diameter nearly equal to the usable width of the belt) forced gas convection heat transfer coefficient on the upper conveyor. The forced gas convection heat transfer coefficient is only limited by the weight and shape of the products to be refrigerated, since increasing the rotation speed and/or the pitch of the blades of the fans will increase the coefficient until the flow created by the fans blows the products off the conveyor (which explains why some refrigeration tunnels, such as the ULTRAFREEZE®, use variable fan speed control). However, the circulation of the cold gas created by the top-mounted fans is moderate at best on the lower tiers, since the lower tiers are separated from the fans by a nearly solid plane obstruction composed of both the product-carrying portion of and the return portion of the endless conveyor belts and of the products resting on the belts.

The side-mounted fans versions yield heat transfer processes with a better uniformity between tiers. However, the heat transfer process on the upper tier created by the fans is weaker than the heat transfer process on the upper tier created by the top-mounted fans version, since the fan delivery is now divided between two or more, but typically three, tiers. Also, the heat transfer process created by the side-mounted fans is not uniform across the width of the various conveyor belts, since the products on the outer edges of the belts have some lateral surface directly exposed to the flow created by the fans, while the remaining lateral surface is shielded from the flow by the product itself, and since the products on the outer edges of the belts are directly exposed to the flow created by the fans, while the following products, along the width of the belts) are increasingly shielded from the flow.

Also, the side-mounted fans versions require some structural modifications to the refrigeration tunnel design which have undesirable consequences. The fans are mounted either on the insulated enclosure with the motors in the ambient atmosphere or on a fixed frame within the insulated enclosure with the motors in the cold gas atmosphere. With the outer-side-mounted fans version, it is no longer possible to open manually the horizontally hinged side doors of the modular sections of a linear freezer initially designed in that fashion (e.g., the ULTRAFREEZE®). This is so first because of the increased weight of the side doors, second because of safety considerations, and third because of increased design complexity. Outer-side-mounted fans are typically found on multi-tier refrigeration tunnels, the insulated enclosures of which consist of a flat bed and an upper enclosure, the enclosure consisting of a top and lateral insulation panels, the flat bed and upper enclosure being of the non-modular type, and the upper enclosure being hydraulically lifted for washdown or repairs or after production incidents. With the inner-side-mounted fans versions, modular construction is still possible, but the volume of the insulated enclosure is increased, the fan motors give off heat in the cold gas atmosphere, the specifications on the fan motors are more severe, and correct washdown of such linear freezers is complicated due to the additional area and due to the additional recesses suitable for bacterial development.

In summary, it is the opinion of the inventors that prior-art multi-tier refrigeration tunnels offer the choices among:

(a) multi-tier refrigeration tunnels with top-side-mounted fans which can be of modular construction, thereby providing simplicity in installation, in size increase or decrease, ease in use, cleaning, and resolving production incidents; and which provide a very fast and nearly uniform heat transfer on the upper tier, but which provide only moderate to very slow heat transfer on the lower tiers; or (b) multi-tier refrigeration tunnels with inner-side-mounted fans which can be of modular construction, thereby providing simplicity in installation, in size increase or decrease, possible ease in use and in resolving production incidents; and which may provide uniform heat transfer process between tiers. However, such freezers do not provide a uniform heat transfer across the width of the belts, they do not provide a very fast and uniform heat transfer on the upper tier, they are harder to clean, they require fan motors rated for very low temperatures, they require a greater insulated volume, they have higher steady state heat losses because of the fan motors, which cause heat losses to the cold atmosphere within the insulated volume; or (c) multi-tier refrigeration tunnels with outer-side-mounted fans which may provide a uniform heat transfer process between tiers. However, they cannot be of the modular type without a significant increase in design complexity, they do not provide a very fast and nearly uniform heat transfer on the upper tier, and they do not provide a uniform heat transfer across the width of the belts.

OBJECTS OF THE INVENTION

It is an object of the invention to provide improved multi-tiered linear refrigeration tunnels.

It is another object of the invention to increase the production capacity of multi-tier linear refrigeration tunnels without increasing the conveyor belt lengths.

It is still another object of the invention to increase the production capacity of a multi-tier modular linear refrigeration tunnel without installing motors within the cold gas atmosphere within the insulation enclosure of the tunnel.

It is still another object of the invention to significantly enhance the heat transfer process on the lower tiers of a multi-tier linear refrigeration tunnel without sacrificing efficiency.

It is still another object of the invention to perform that heat transfer process enhancement without increasing the number of fan motors on multi-tier refrigeration tunnels of modular construction equipped with lateral doors and a stationary tunnel ceiling with respect to the tunnel floor.

It is still another object of the invention to perform the same heat transfer enhancement method as in the previous object of the invention on multi-tier refrigeration tunnels not equipped with lateral doors but with a movable tunnel ceiling with respect to the tunnel floor, through doubling the number of fan motors.

It is still another object of the invention to offer an alternative heat transfer enhancement method on multi-tier refrigeration tunnels, preferably (but not limited to) tunnels not equipped with lateral doors, whereby a lesser amount of modifications are needed but whereby the enhancement is of a lower magnitude than the one realized with the previous two methods.

It is still another object of the invention to optimize the location of the liquid cryogen injection means when applicable.

It is still another object of the invention to enable multi-tier (and, by extension, single-tier) refrigeration tunnels to process simultaneously two different products requiring different dwell times.

Other objects of the invention will become apparent from the summary of the invention and from the description of the appended drawings.

SUMMARY OF THE INVENTION

According to some aspects of this invention, the invention aims at optimizing the circulation characteristics of the cold gas atmosphere within the insulated enclosure of a multi-tier linear refrigeration tunnel in order to provide maximum refrigeration on all tiers of the refrigeration tunnel and in order to provide uniform refrigeration across the width of the tiers of the refrigeration tunnel. According to further aspects of the present invention, the circulation characteristics optimization is to be obtained without adversely affecting the other characteristics of the tunnels (e.g., manufacturing costs, modularity of the equipment when applicable, parasite heat loads in the equipment, simplicity of equipment washdown procedure, and simplicity of resolving production incidents).

The circulation characteristics optimization method uses means to duplicate on the lower tiers of a multi-tier linear refrigeration tunnel the cold gas circulation characteristics found on the upper tier of multi-tier linear refrigeration tunnels equipped with high velocity and high delivery top-mounted fans.

According to the preferred embodiment of the invention (but not limited to the preferred embodiment), the cold gas circulation characteristics optimization means are implemented in multi-tier linear refrigeration tunnels of modular construction (in order to keep the many advantages of modular construction) with top-mounted fans.

According to another embodiment of the invention, the optimization means includes a modified beltconveyor tiers-support frame. The modifications allow for two horizontal and side-to-side stainless steel or other suitable material endless belts to be supported and guided by the modified frame. The modifications further allow the maintenance of a longitudinal gap between the separate belts, the gap being of a suitable width, but no less than 1.5 inches and no more than 4 inches. The modified frame further supports vertical product guards of suitable height, but no less than 0.5 inches and no more than 1.5 inches, when applicable (light products).

According to still another embodiment of the invention, the optimization means include an extended shaft from each of the existing top-mounted fan motors. The shaft extends through the previously mentioned gap between the previously mentioned separate belts on each tier to the bottom of the multi-tier tunnel, where it is guided by an outboard bearing.

According to still another embodiment of the invention, fans of selected type, pitch, and diameter are mounted on each extended shaft, the number of the fans being equal to the number of the tiers, in such a manner that one and only one fan is located above each tier at each extended shaft location.

According to still another embodiment of the invention, the previously mentioned modified belt conveyor tier support frame is further modified to allow for vertical relocation of the belt conveyor support tiers in order to allow for uniform clearance between the previously mentioned fans and the previously mentioned tiers to which those fans are assigned and to allow for uniform clearance above the fans, thereby creating the same heat transfer conditions on all tiers.

According to still another embodiment of the invention, the height of the insulation enclosure which delimits the tunnel may be increased in order to provide greater clearance above the previously mentioned fans when necessary, thereby providing optimum operating conditions for the fans.

According to still another embodiment of the invention, each of the previously mentioned extended shafts is driven by a top-mounted motor of power suitable to drive all fans mounted on the shaft up to rotations speeds that create a flow powerful enough to blow small products off the belts. The motors are of variable speed, thereby allowing the operator of the equipment to set the fan rotation speed to just below the level that blows the products off the belts, thereby maximizing the heat transfer coefficient without blowing the products off the belts.

According to still another embodiment of the invention, product guards which are shaped similar to a gable are added to the previously mentioned belt conveyor tier support frame at selected locations. The selected locations are the regions between the previously mentioned separate and parallel belts of each tier at the product loading zone and at the product transfer zone from each tier to the next lower tier. This arrangement allows transfer of the products without loss, such as products falling through the previously mentioned gaps between separate and parallel conveyor belts and accumulating at the bottom of the refrigeration tunnel.

The above listed embodiments of the present invention optimize the heat transfer process on the upper surfaces of the products to be refrigerated, the upper surfaces being directly exposed to the flow created by the fans above the products. Additionally, the above listed embodiments, because of the synergistic effect between all the fans on each extended shaft, also allow for an enhancement of the heat transfer process on the lateral surfaces of the products and for an improvement of the heat transfer process on the underside of the products.

Combination of the above listed embodiments of the invention yields a significant production capacity increase for the multi-tier refrigeration tunnel, since the rate of removal of heat from the products transported by the lower tiers is significantly enhanced.

According to a further embodiment of the invention, use of the above listed embodiments in a multi-tier linear refrigeration tunnel with an expandable refrigeration source (such as liquid carbon dioxide) will require an increased number of cryogen injection orifices or cryogen injection nozzles or other suitable cryogen injection means, since the increased production capacity of the tunnels with the embodiments requires increased expandable cryogen injection rates. The further embodiment distributes the required injection orifices or nozzles in a suitable pattern which is a function of the design of the refrigeration equipment, thereby compensating for zones of weak ventilation when applicable, such as the case of a refrigeration tunnel which by design uses fan blades of diameters significantly less than the width of the conveyor belt tiers. The further embodiment also allows for a very precise temperature profile regulation within the refrigeration equipment by combining a zone of injection nozzles or orifices with a dedicated temperature sensor and a dedicated flow and temperature controller. Finally, the further embodiment also allows for concentrating injection nozzles or orifices in zones of high heat loads, such as zones near the entry of the refrigeration tunnel, where warm products enter the refrigeration tunnel.

Combination of the above listed embodiments of the invention yields a large production capacity increase of the multi-tier refrigeration tunnel without increasing the number of fan motors, without requiring low temperature rated motors, and without losing modularity of the tunnels. The inventors have measured the heat transfer coefficients on the lower two tiers of a typical three tier tunnel with near 100% product loading density, and they have found the bottom tiers heat transfer coefficients to amount to only 20 to 30% of the top tier heat transfer coefficient, the top tier heat transfer coefficient having been measured at 16 Btus/sq ft.°F. hr. The ratio of bottom versus top tier heat transfer coefficients lead to the estimate of a potential production increase by 80% to 120% compared to multi-tier tunnels with top mounted fans of the prior art. However, it must be taken into account that the heat transfer driving force is decreasing with time because the temperature of the surface of the product decreases with time, but also that the products can be flipped over during the transfer from one upper tier to one lower tier, thereby presenting the previously lower surface to the downward flow, thereby increasing the heat transfer driving force. Tests on beef patties, which flipped over during the transfer operations, have shown that 70% of the enthalpy removal occurred on the upper tier compared to only 30% on the bottom tiers, although the dwelltime on each tier was constant. Those tests have also shown that the dwelltime with the embodiments of the present invention can be reduced by 48% (5 min. 30 secs. compared to 10 min. 40 secs. to remove about 100 Btus/lb from the patties, which corresponds roughly to a temperature drop from 40° F. to about 15° F.) and that consequently the production capacity is increased by about 90%. That figure is, however, only indicative, since the actual production capacity increase will depend on the prior art design characteristics, the product characteristics, the loading density, and the density of the mesh of the product carrying conveyor belts. In any case or design, the production capacity increase is estimated to be at least 40%, and possibly as high as 90% — as shown by the above results. The production capacity increase enables the use of a shorter tunnel for set production conditions, thereby saving floor space at the processors. The shorter tunnel contains less mass (belts and insulation enclosure) than presently known tunnels for a given production capacity, thereby reducing the amount of refrigeration (mass of expandable refrigeration source) that is needed to achieve the equipment cooldown (i.e., bringing the equipment from ambient condition to refrigeration conditions). The above listed embodiments of the invention, necessary to achieve the production capacity increase, have a manufacturing cost significantly lower than that of the now unnecessary length of tunnel that the production capacity increase eliminates, thereby lowering the manufacturing cost of a multi-tier tunnel, at the same production capacity, compared to the existing technology. Since the multi-tier tunnel of this invention is shorter than presently known ones, at given production capacity, the area of heat transfer between the cold atmosphere within the insulated enclosure and the ambient atmosphere outside of the insulated enclosure, by conduction through the insulation wall, is greatly reduced, thereby leading to a reduction in equipment heat losses at given production capacity. Previously mentioned increased cryogen injection rates yield a higher positive pressure within the enclosure, thereby reducing leaks of warm moist room air into the enclosure and thereby further reducing the equipment heat losses.

According to still another embodiment of the invention, the previously mentioned belt conveyor support frame allows for using separate belt drive shafts and belt return shafts, the shafts acting on only one belt and not simultaneously on the two separate and parallel belts of each tier. According to a further embodiment of the invention, the drive shafts are provided with their dedicated drive motor or drive mechanisms and with their dedicated speed controls. The embodiments enable the user to set a selected processing time on the left-hand side belts and to simultaneously set a selected processing time on the right-hand side belts. The right-hand side processing time is equal to or different from, but typically different from, the left-hand side processing time, thereby enabling the refrigeration equipment to simultaneously process two different products with different required processing times and thereby allowing the equipment operator, such as a food freezing processor, to have a smoother product flow and plant operation and/or to reduce the expandable refrigeration source consumption and the floor space required by the equipment since, with the prior art, food processors expressing their need for a "two product line" have to settle for either two separate and under-utilized refrigeration tunnels or for alternation of products on a single refrigeration tunnel.

According to another embodiment, production capacities may be increased on a multi-tier refrigeration tunnel without the use of the above listed embodiments, and especially without using two separate belts per tier. However, this embodiment will not provide as great a production capacity increase as the above listed embodiments. This embodiment combines the advantages of the presently known multi-tier linear refrigeration tunnels with top-mounted fans and the presently known multi-tier linear refrigeration tunnels with side-mounted fans, and it eliminates some of the drawbacks of the presently known multi-tier tunnels. According to this embodiment, side-mounted fans are added to the design of presently known multi-tier linear refrigeration tunnels with top-mounted fans. The side-mounted fans are placed in such a configuration that they do not create cold gas circulation on the upper tier, but only on the lower (typically two) tiers. According to a preferred embodiment, this configuration consists of fan blades of radius greater than the clearance between two superposed tiers, the shafts of the fans being located below the level of the middle tier of the three tier linear freezer, and more specifically between 0.5 inch and 1.5 inches above the middle plane between the product carrying portions of the middle tier belt and of the bottom tier belt.

BRIEF DESCRIPTION OF THE DRAWINGS

Other and further features of the invention will be clearly understood by reference to the following description of various embodiments of the invention chosen for a purpose of illustration only, along with the claims and the accompanying drawings.

FIG. 6 also shows the flow field created by the top-mounted propellers and the zone of influence of the side-mounted liquid cryogen injection apparatus when applicable.

DETAILED DESCRIPTIONS OF THE PRESENTLY PREFERRED EMBODIMENTS

Figure 1:
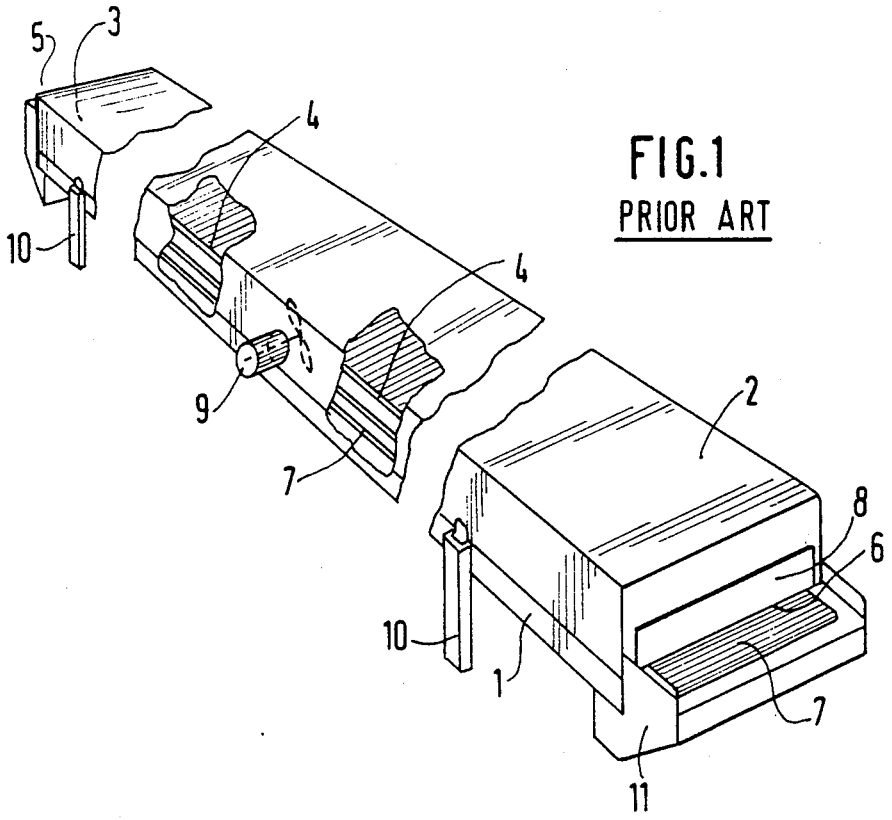
FIG.1 PRIOR ART
FIG. 1 is an overall view of a previously known multi-tier refrigeration tunnel, not of modular construction, without lateral doors, and using outer-side-mounted fan motors.

FIG. 1 shows schematically the basic design of a multi-tier linear refrigeration tunnel of non-modular construction with outer-side-mounted fans. The freezer is delimited by an insulated enclosure comprised of a flat bed 1 and a U-shaped upper enclosure 2. The upper enclosure 2 has a product entry opening 3 through which products placed on the upper tier 4 at the loading zone 5 enter the equipment and a product exit opening 6 through which products carried by the bottom tier 7 leave the equipment. The openings 3, 6 can be of adjustable cross section through the use of an adjustable sliding baffle 8. An expandable liquid cryogen such as carbon dioxide or nitrogen or another suitable refrigeration source is injected into the volume deliminated by the flat bed 1 and the upper enclosure 2 through suitable means such as nozzles (not shown in FIG. 1), and the flow of the cryogen is controlled, typically by solenoid valve or proportional valves (not shown in FIG. 1), based on the temperatures measured by suitably located temperature sensors (not shown in FIG. 1). The circulation of cold gas within the enclosure is created by side-mounted fans such as 9. The configuration of the side-mounted fans 9 depends on the equipment design. However, typically one row of side-mounted fans 9 is located on each of the two lateral sides of the upper enclosure 2, the fans of the rows alternating in position rather than facing each other. Access to the inner parts of the equipment for cleaning, maintenance, and solution to production incidents is made possible by either lifting the upper enclosure 2 or by lowering the flat bed 1 using hydraulic mechanisms 10. Finally, the cold cryogen gases are exhausted at both ends of the equipment by suitable exhaust troughs 11 of various designs.

Figure 2:
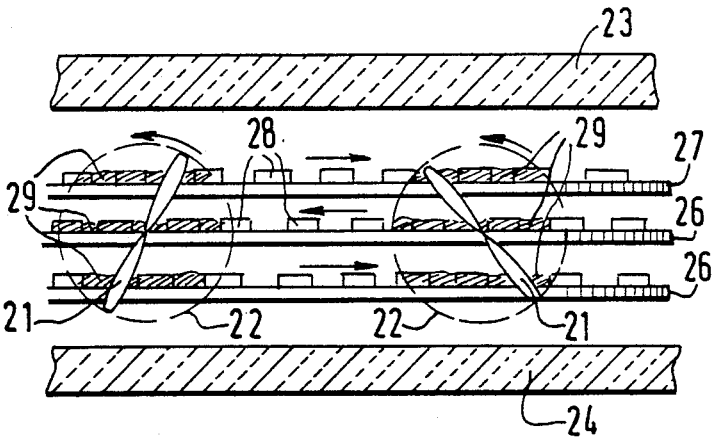
FIG. 2 PRIOR ART
FIG. 2 is a cross sectional view of the tunnel shown in FIG. 1, along the length axis of the tunnel, showing the relationship between flow delivery area of the side-mounted propellers and area of the products transported by the various tiers and exposed to the flow.
Figure 3:
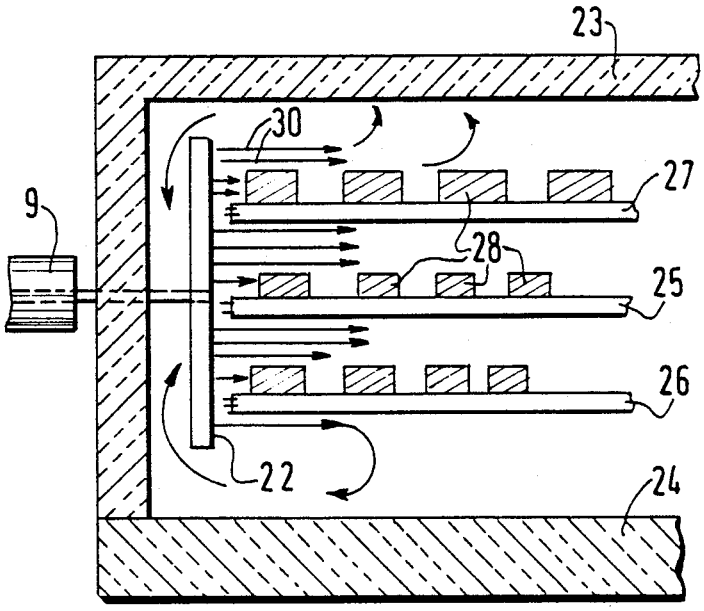
FIG. 3 PRIOR ART
FIG. 3 is a cross sectional view of the tunnel shown in FIG. 1, along the width axis of the tunnel, showing the flow field created by the side-mounted propellers and its geometrical relation to the volume occupied by the products to be refrigerated.

FIGS. 2 and 3 show schematically the flow patterns that are expected in a three-tier linear refrigeration tunnel having side-mounted fans. In FIG. 2, the propellers 21 of two side-mounted fans have been represented. Their rotation describes a circular area which, in projection, creates a flow delivery volume 22 located between the top 23 and the bottom 24 of the refrigeration equipment. The flow delivery volume 22 is roughly centered on the level of the middle tier 25, but it is of radius large enough to include part of the bottom tier 26 and part of the upper tier 27. Some typical products 28 are represented in FIG. 2 as they are transported through the tunnel. As can be seen from FIG. 2, not only is the flow delivery from the propellers 21 divided between the three tiers 25, 26, 27, but the products 28 lying on the tiers do not see even one third of the flow delivery area in the flow delivery volume 22 since the intersection of the product lateral surfaces with the flow delivery surface is considerably less than one third of the cross sectional area of the flow delivery volume 22 as shown by the shaded areas 29 in FIG. 2. The flow created by the propellers 21 in the flow delivery volumes 22 is schematically represented in FIG. 3 by arrows 30. As can be seen from FIG. 3, the products 28 which are on the outer edge of the tiers 25, 26, 27 are closest to the propellers 22 and are directly exposed to the flow created by the propellers 22, and they are accordingly quickly refrigerated. The products 28 that are not on the outer edges of the tiers 25, 26, 27 are, however, increasingly shielded from the flow, and they are accordingly slowly refrigerated.

Figure 4:
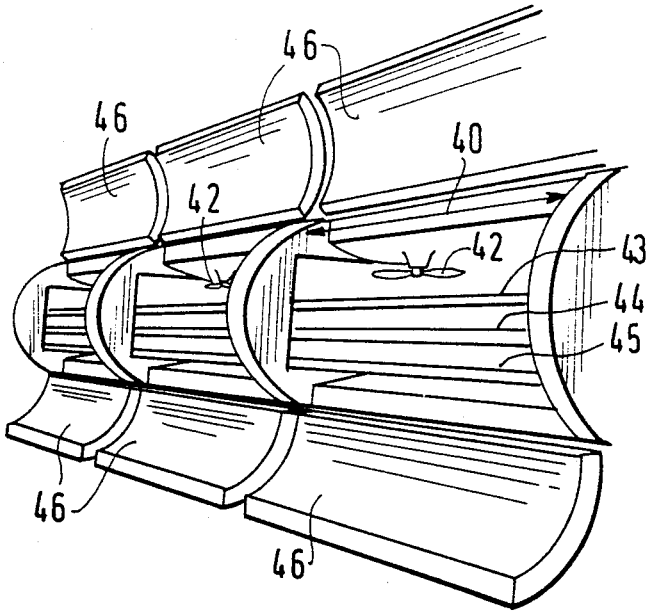
FIG. 4 PRIOR ART
FIG. 4 is an overall view of a previously known multi-tier refrigeration tunnel, of modular construction, with lateral doors, and using top-mounted fan motors.
Figure 5:
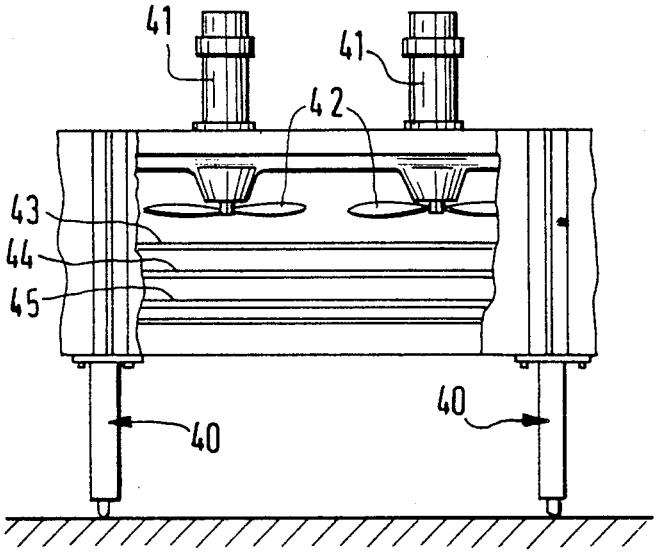
FIG. 5 PRIOR ART
FIG. 5 is a cross sectional view of the tunnel shown in FIG. 4, along the length axis of the tunnel, showing the relative position of the propellers and the tiers.

FIGS. 4 and 5 show schematically the basic design of a multi-tier linear refrigeration tunnel of modular construction with top-mounted fans. The freezer is delimited by an insulated enclosure composed of several modular sections 40 joined together. As for the multi-tier linear refrigeration tunnel of nonmodular construction with side-mounted fans, the freezer is equipped with means to load and unload the products to be refrigerated, with means for the products to enter and leave the insulated enclosure, with means for adjusting the cross section of the openings allowing for entry and exit of the products, with means for injecting an expandable refrigeration source into the volume of the insulated enclosure, with means for regulating the flow of the refrigeration source, and with means for removing the exhaust gas from the insulated enclosure (none of these means being represented in FIGS. 4 and 5). The circulation of cold gas within the enclosure is created by top-mounted fan motors 41 and horizontal propellers 42 above the upper tier 43 and not above the middle tier 44 and not above the bottom tier 45. Shown here are two fans per modular section. Access to the inner parts of the equipment for cleaning, maintenance, and solution to production incidents is made possible by opening the side doors 46 — manually in the case of the illustrated design, but also hydraulically in the case of heavier door designs.

Figure 6:
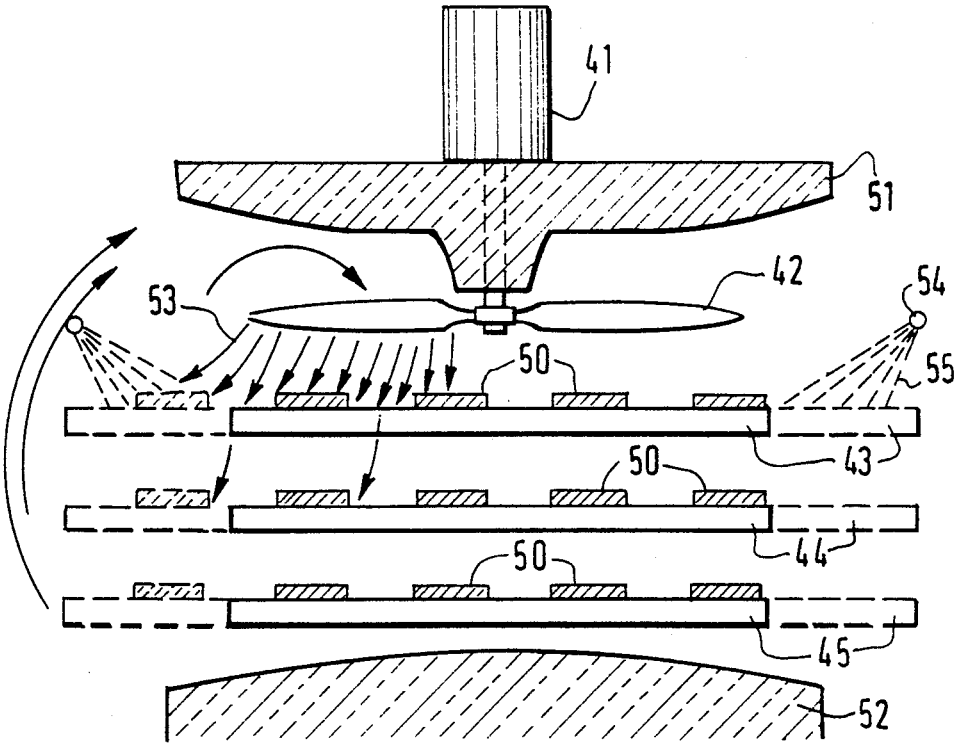
FIG. 6 PRIOR ART
FIG. 6 is a cross sectional view of the tunnel shown in FIG. 4, along the width axis of the tunnel, showing the relative position of the propellers and the tiers, with the propeller diameters being nearly equal to the tier width in full contours, and with the propeller diameters being significantly smaller than the tier width in dashed contours.

FIG. 6 shows schematically the flow patterns that are expected in a three tier linear refrigeration tunnel having top-mounted fans. The propeller 42 driven by the motor 41 mounted on the top 51 of the insulated enclosure creates an essentially cylindrical and downward flow of cold gas as shown by the arrows 53, thereby refrigerating the products 50 lying on the upper tier 43, primarily by heat transfer between the cold gas and the upper surfaces of the products 50 and secondarily by heat transfer between the cold gas and the lateral surfaces of the products 50. The numeral 52 represents the bottom of the insulated enclosure. Not represented in FIG. 6 are the horizontal flow vectors created by the propeller 42 at the edge of the propeller, since the horizontal flow vectors are of little consequence on the refrigeration kinetics. The downward flow essentially bounces back from the products 50 loaded on the upper tier 43 because of the solid obstruction created by the combined products and belt. Even in the case of an upper tier 43 without products 50 loaded on it, although the flow created by the propeller 42 is able to pass through the two belt portions of the upper tier 43, it does so at a significant velocity reduction, the size of which depends on the mesh density of the belts. As a result, the cold gas circulation is weak above the middle tier 44 and essentially nonexistent above the bottom tier 45, thereby leading to very low refrigeration kinetics on the middle and bottom tiers. As a result, it is established experimentally that the two lower tiers, although they represent 67% of the total usable belt length, contribute only 20 to 35% (depending on product loading) to the overall refrigeration process. As a consequence, the production capacity of a modular multi-tier tunnel having top-mounted fans is only 45 to 55% of the production capacity of a single-tier tunnel having top-mounted fans of the same belt width and total belt length (and, of course, the same fan characteristics and rotation speeds).

FIG. 6 also shows that it is possible to use propellers 42 of diameters smaller than the width of the tiers (represented by dotted contours in FIG. 6) by using the heat transfer process created by the kinetic energy of the expansion jets 55 of a high pressure expandable refrigeration source such as carbon dioxide that is injected into the inner volume of the tunnel by means of nozzles or orifices in a tubular header 54 and/or by using the two-phase heat transfer realized when depositing the condensed phase of the cryogen onto the surface of the products.

Figure 7:
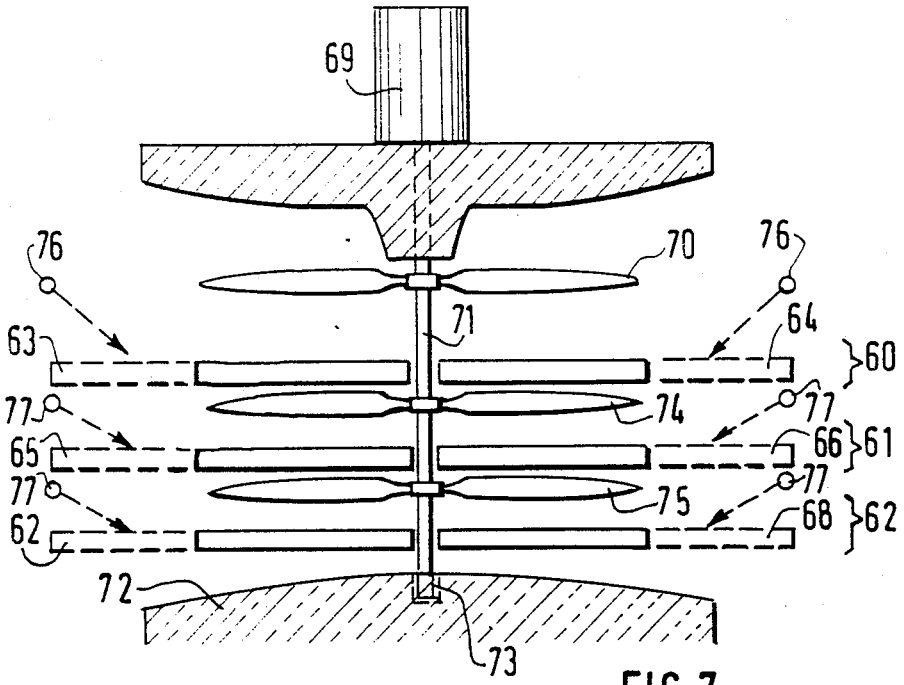
FIG. 7 is a cross sectional view of a multi-tier refrigeration tunnel, of compact design with lateral doors and with top mounted fan motors, according to the present invention, and shows the extended fan shaft, the thereto added fan propellers, and the two separate and parallel conveyor belts on each tier, and the additional cryogen injection means.

FIG. 7 shows schematically several embodiments of the present invention, the combination of the embodiments leading to an improved heat transfer process on the middle tier 61 and on the bottom tier 62. The design of the belt conveyor support frame (not shown in FIG. 7) is modified in order to support two separate and parallel belts 63 and 64 on the upper tier 60, two separate and parallel belts 65 and 66 on the middle tier 61, and two separate and parallel belts 67 and 68 on the bottom tier 62.

The inner edges of the separate belts on each tier (63 and 64; 65 and 66; 67 and 68) are parallel and separated by a gap of selected width. The gap enables the replacement of the existing shaft of the top-mounted fan motor 69 and the fan propeller 70 by an extended shaft 71. The shaft 71 extends to the bottom panel 72 of the tunnel, where it s guided by a bearing 73. Three fan propellers are mounted on each extended shaft 71, one propeller 70 above the upper tier 60 at the same location as in the non-modified tunnel, one fan propeller 74 above the middle tier 61 and below the upper tier 60, and one fan propeller 75 above the bottom tier 62 and below the middle tier 61. When using an expandable refrigeration source such as a suitable liquid cryogen, the increased production capacity due to the enhanced heat transfer process on the lower tiers requires an increased cryogen injection rate. In addition to the existing cryogen injection orifices or nozzles 76 located above the upper tier 60 (either on the outer edges as shown in FIG. 7 in the case of propeller diameter significantly smaller than usable tier width shown by dashed contours in FIG. 7, or distributed widthwise in the case of propeller diameters nearly equal to the usable tier width), cryogen injection orifices or nozzles 77 are installed above the middle tier 61 and above the bottom tier 62, either on the outer edges (as shown in FIG. 7) or distributed widthwise across the tiers, depending on the ratio of the propeller diameter to the usable tier width. Cryogen supply tubing to the injection orifices or nozzles is not shown in FIG. 7.

Figure 8:
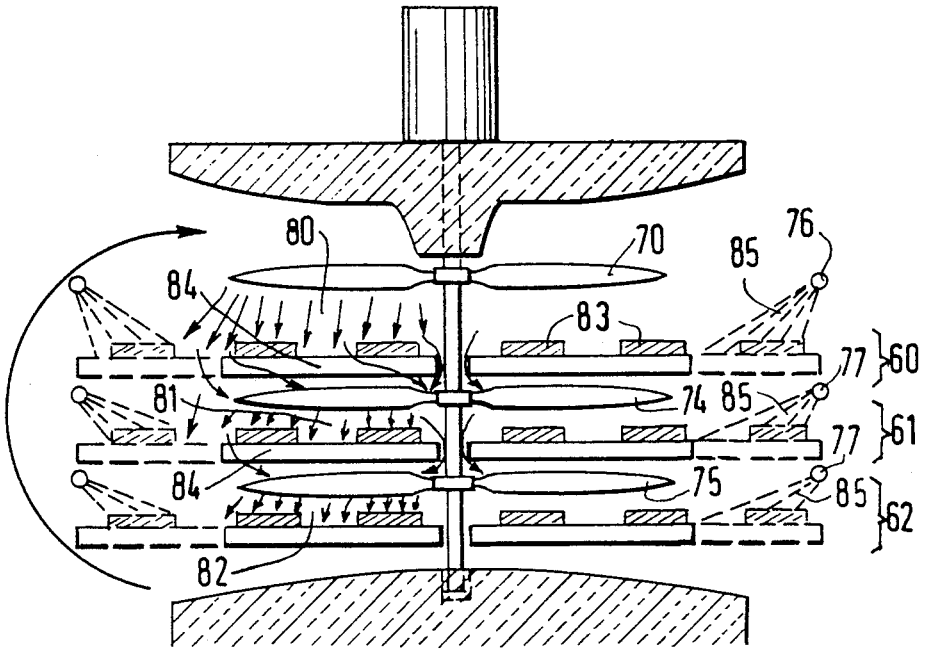
FIG. 8 is a cross sectional view showing the flow field created by embodiments of the present invention as shown in FIG. 7.

FIG. 8 shows schematically the flow pattern resulting from the embodiments of the invention as shown in FIG. 7. Fan propellers 70, 74, and 75 create an essentially downward flow of cold gas as shown by arrows 80, 81, and 82, and the velocity of the flow in the vicinity of the products 83 to be refrigerated results in a heat transfer coefficient applied to the products 83. As illustrated by arrows 81 and 82, the forced gas convection on the lower tiers 61 and 62 is significantly enhanced by those embodiments of the invention when compared to the flow pattern in the present design as shown in FIG. 6, despite some possible cavitation occurring in the suction space over the fan propellers 74 and 75 because of the limited volume of that suction space in the case of multi-tier refrigeration tunnels of compact design. The suction creates a flow 84 through the belts of the upper tier 60 and the belts of the middle tier 61, thereby enhancing the heat transfer process on the lateral sides and on the underside of the products 83. In addition to possible cavitation of the fan propellers 74 and 75, the design of FIG. 7 and 8 has the drawback of the product clearance reduced by 2 to 2.5 inches on the middle tier 61 and on the bottom tier 62, which can be a problem in multi-tier tunnels of compact design. As described earlier for FIG. 6, the expansion jets 85 of an expandable refrigeration source such as a suitable liquid cryogen from the cryogen injection means, such as the nozzles 76 or orifices, above the upper tier 60 create a heat transfer process by the combined action of the deposition of a more or less dispersed layer of the condensed phase (under near atmospheric pressure) of the cryogen onto the upper surface of the products 83 (film boiling or sublimation depending on the type of cryogen) and of the kinetic energy of the expansion jet, especially in the case of high pressure liquid cryogen delivery, typically carbon dioxide. The heat transfer process created by the cryogen injection means can be used to compensate for areas of weak ventilation, such as exist in the case of tunnels using fan propellers of diameters smaller than the usable width of the tier (represented in FIG. 8). The heat transfer process created by the cryogen injection means can also be used to increase the heat transfer process overall. The cryogen injection means are then distributed uniformly over the width of the tier with carefully selected injection surfacic coverage density (this set up is not shown in FIG. 8). The use of that heat transfer process is duplicated on the middle tier 61 and on the bottom tier 62 by positioning the additional cryogen injection means, as required by the increased production capacity, in a fashion similar to the positioning of the nozzle 76 as applied to the middle tier 61 and the bottom tier 62.

Figure 9:
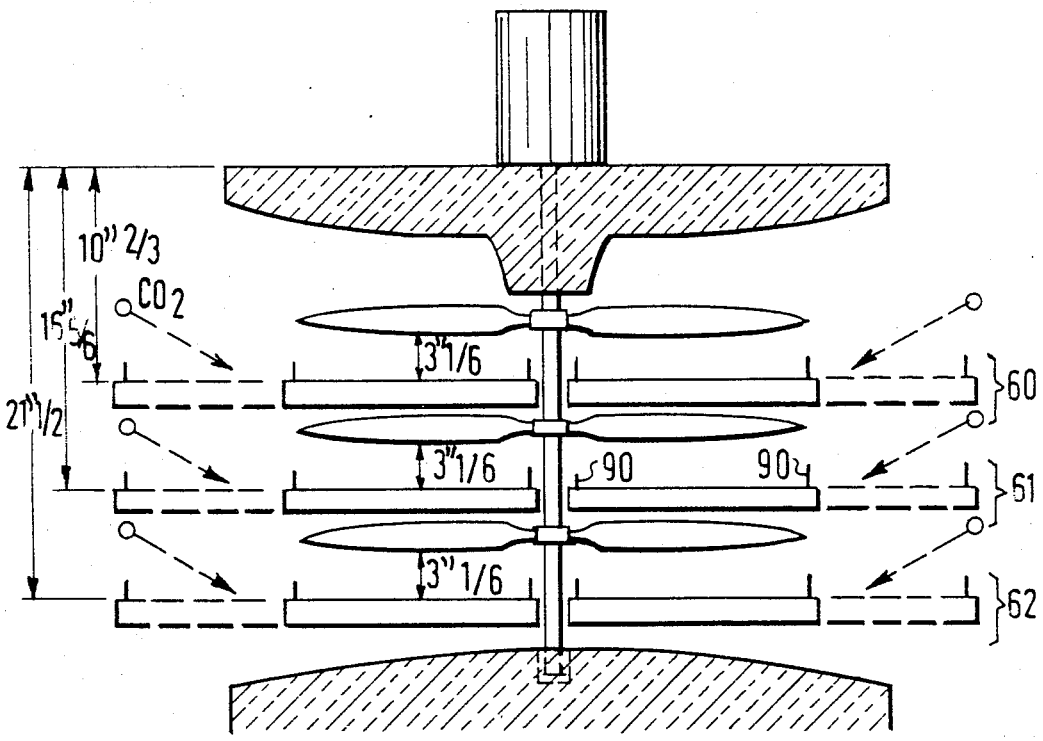
FIG. 9 is a cross sectional view of a multi-tier refrigeration tunnel, of compact design, with lateral doors and with top-mounted fan motors, according to a second embodiment of the present invention. This embodiment allows for uniform product clearance between the tiers.

FIG. 9 represents schematically a further embodiment of the invention in which the product clearance is made identical on the upper tier 60, the middle tier 61, and the bottom tier 62. This result is achieved by a further modification of the conveyor belts support frame which allows for raising, within the existing refrigeration tunnel insulated enclosure, the upper tier 60 and the middle tier 61 by amounts such that an equal spacing is obtained between each tier and the fan immediately above that tier. Levels of tiers with respect to the top of the multi-tier refrigeration tunnel as shown in FIG. 9 are for illustration purposes only and are not restrictive. Also shown in FIG. 9 are the side product guards 90 which prevent products spilling over the edges of the belts in the case of light bulk products. The side product guards 90 are the same as existing product guards.

Figure 10:
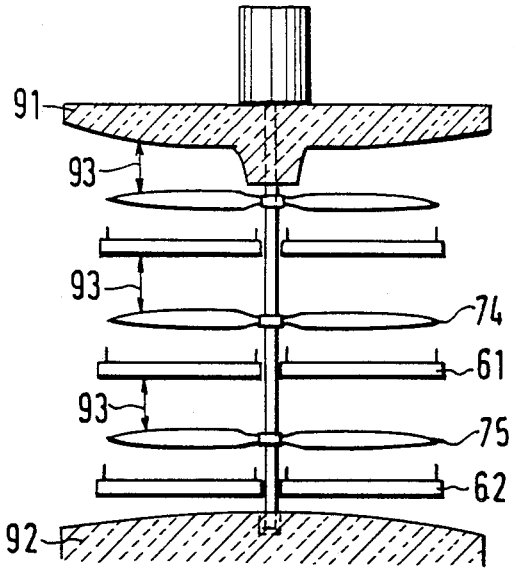
FIG. 10 is a cross sectional view of a multi-tier refrigeration tunnel, with lateral doors and with top-mounted fans, according to a third and preferred embodiment of the invention. This embodiment allows not only for uniform product clearance between tiers, but also for optimum operation of propellers, as shown by the flow field created by the propellers as shown in FIG. 11.

FIG. 10 represents schematically a further and preferred embodiment of the invention which requires a modification to the modular tunnel enclosure in order to achieve a greater usable height between the bottom 92 of the refrigeration tunnel enclosure and the top 91 of the refrigeration tunnel enclosure. The modification is necessary to obtain the best results from the above described embodiments when applied to a multi-tier refrigeration tunnel of initially compact design. The increase in usable height, together with suitable dimensions for the belt conveyors support frame, allows for a large head space 93 above the fan propeller 74 assigned to the middle tier 61 and above the fan propeller 75 assigned to the bottom tier 62, thereby avoiding cavitation of the propellers 74 and 75. Although not critical, the above described spacing ensures optimum fan propellers operation and thereby minimizes the power consumption necessary to achieve the desired heat transfer process on the products transported by the lower tiers.

Figure 11:
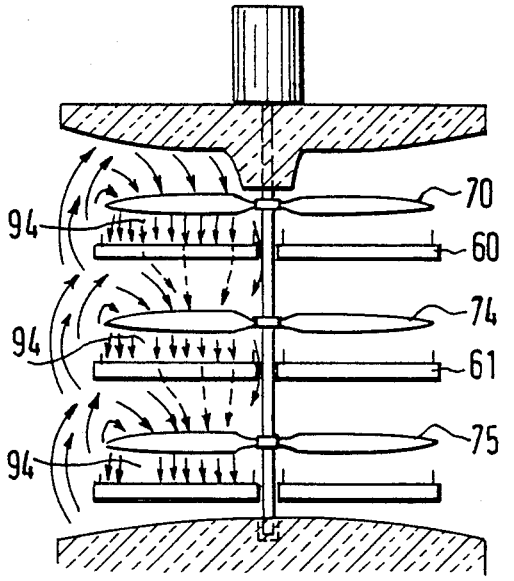
FIG. 11 is the flow field created in the equipment designed as shown in FIG. 10.

FIG. 11 represents schematically the flow pattern realized in a multi-tier refrigeration tunnel of geometry and design according to FIG. 10. The fan propellers 70, 74, and 75 create an essentially downward flow of cold gas as shown by the arrows 94. Some of the flow created by the fan propellers 70 and 74 is pulled through the belt mesh of the upper tier 60 and the middle tier 61, respectively, thereby improving the heat removal process from the lateral sides and from the underside of the products being transported by the endless conveyor belts of the upper and the middle tiers. The spacing between the top 91 of the refrigeration tunnel and the propeller 70, between the upper tier 60 and the propeller 74, and between the middle tier 61 and the propeller 75 provide ample space for recirculation of cold gas, thereby ensuring cavitation-free operation of the propellers 70, 74, and 75 and optimum delivery from the propellers.

Figure 12:
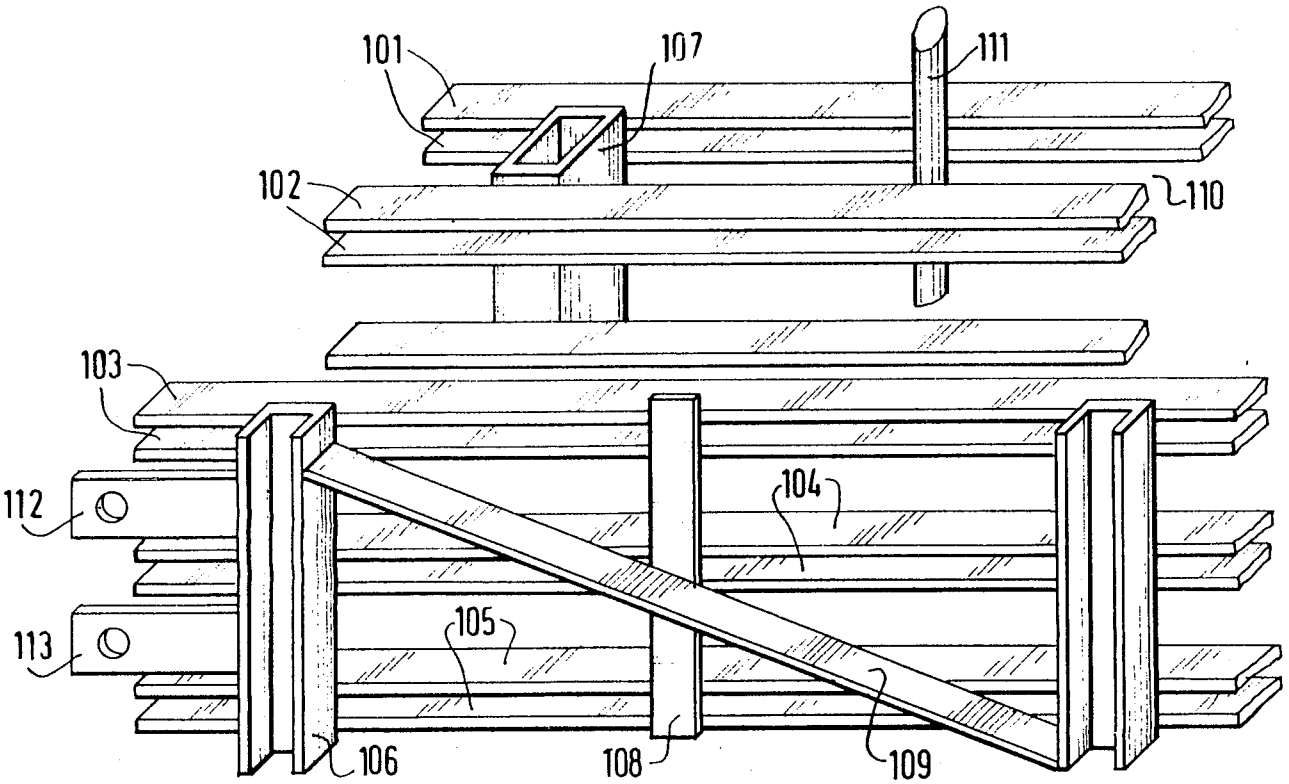
FIG. 12 is an overall view showing the endless conveyor belts support frame according to the present invention, the support frame allowing use of two separate belts per tier as shown in FIG. 7.

FIG. 12 represents schematically the type of conveyor belts support frame that can be used in the multi-tier linear refrigeration equipment that is the subject of this invention. It is understood that variations on this design are possible, but the variations, as long as they enable the use of two separate and parallel endless conveyor belts, must be considered within the scope of the present invention. The support frame illustrated in FIG. 12 is of a modular type, and the portion shown in FIG. 12 is representative of the entire frame except for the entry end and the exit end sections, where the belts drive and return shafts are located. The support frame is composed of independent modular sections. The sections are of length nearly identical to the length of the modular sections, or about 5½ feet in the design of the tunnel as illustrated in FIGS. 4 and 5. The front plane of FIG. 12 shows one half of the modular frame, the other half being symmetrical to the first half. The endless conveyor belts are guided by flat horizontal stainless steel (or other suitable material) rails, the rails being covered by a plastic sheath to allow for smooth gliding of the belts. The belts are guided and supported on both their edges, on the product carrying portion and on the belt return portion. Represented in FIG. 12 are the outer edge rails 103 of the left-hand side conveyor belt of the upper tier, of the middle tier (104), and of the bottom tier (105) and the inner edge rails 102 of the left-hand side conveyor belt of the upper tier and the inner edge rails 101 of the right-hand side conveyor belt of the upper tier. The rails begin as shown on the left-hand side of FIG. 12, but they extend beyond what is shown on the right-hand side of FIG. 12. The rails are supported by U-shaped vertical bars 106 on the outer edges and by the support tubes 107 on the inner edges, the distance between two consecutive support tubes 107 being slightly smaller than one half the length of the tunnel modular section. The distance between two consecutive support tubes 107 is slightly greater than the diameter of the fan propellers used. Although not part of the frame, a portion 111 of the fan shaft is represented for clarification. The fan shaft is located between the inner edge rails of the left-hand side and the inner edge rails of the right-hand side conveyor belts, on the same plane as that defined by the support tubes 107. Rigidity of the frame is insured by flat plates 108 and 109 on the outer edges of the frame and by horizontal rods connecting the support tubes 107 to the vertical bars 106, the number of connection rods depending on the width of the tiers. The modular frame is bolted to the tunnel module insulated enclosure, at both extremities of the frame and on both lateral sides of the frame, through two flat and vertical plates 112 and 113 on each of the four edge support bars 106. Consequently, as can be inferred from FIG. 12, the belt guide rails are not continuous between two consecutive modular tunnel sections, but present a short gap, usually about 1 inch long, which in no way interferes with the support and the guidance of the endless product conveyor belts.

Figure 13:
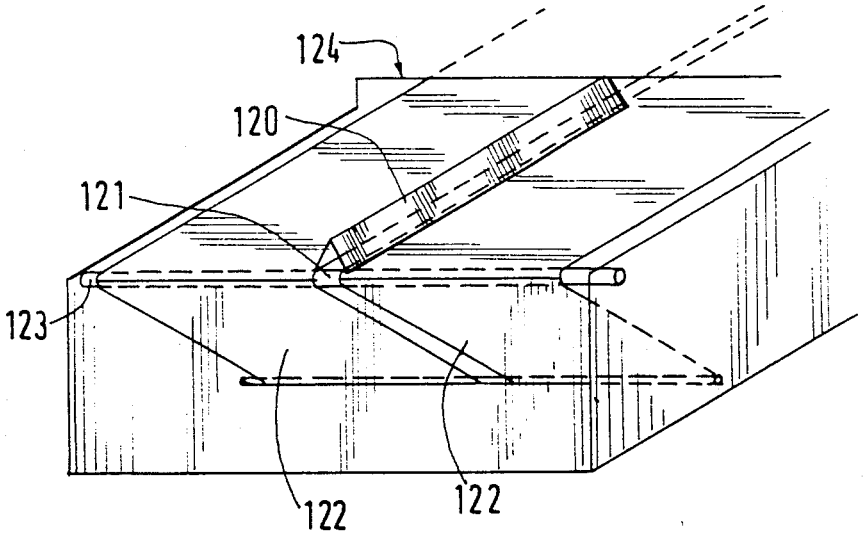
FIG. 13 is an overall view of the product loading zone according to the present invention, showing the product guards used between the two separate and parallel conveyor belts of the top tier at the loading zone.
Figure 14:
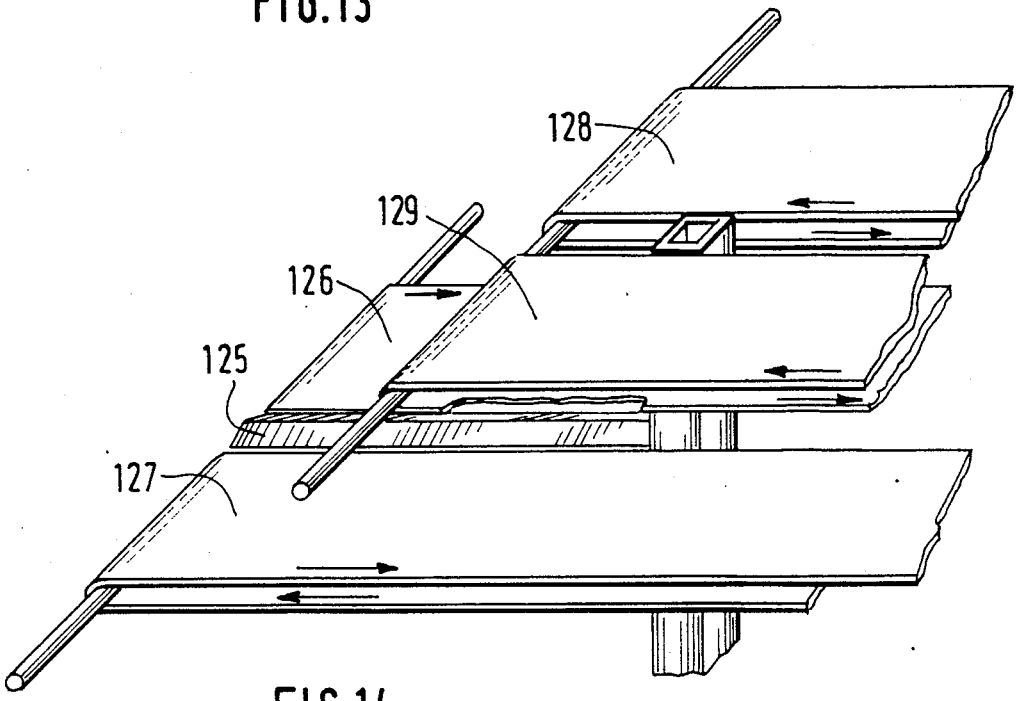
FIG. 14 is an overall view of one product transfer zone within the equipment, from one upper tier to one lower tier, according to the present invention, showing the product guards used between the two separate and parallel conveyor belts of the lower tier at the product transfer zone and part of the conveyor belts support frame as shown in FIG. 12.

FIGS. 13 and 14 represent schematically a further embodiment of the present invention. A product guard 120 in the shape of a gable is added to the product loading zone (FIG. 13) above the gap 121 between the two separate and parallel belts 122 of the upper tier, extending from the return shaft 123 common to the two belts to the product entry end opening 124 into the refrigeration tunnel, thereby avoiding loss of product through the gap 121 and accumulation of the product at the bottom of the loading zone. Similar product guards are added at the product transfer zones from one tier to the next lower tier, such as the product guard 125 located over the gap between the right-hand side 126 and the left-hand side 127 conveyor belts of the middle tier immediately underneath the shaft of the upper tier conveyor belts 128 and 129 near the product exit end of the multi-tier refrigeration tunnel (FIG. 14). The product guards 125 avoid loss of product through the gap between the belts 126 and 127 during transfer of the products from the upper-tier conveyor belts 128 and 129 to the middle-tier conveyor belts 126 and 127.

Figure 15:
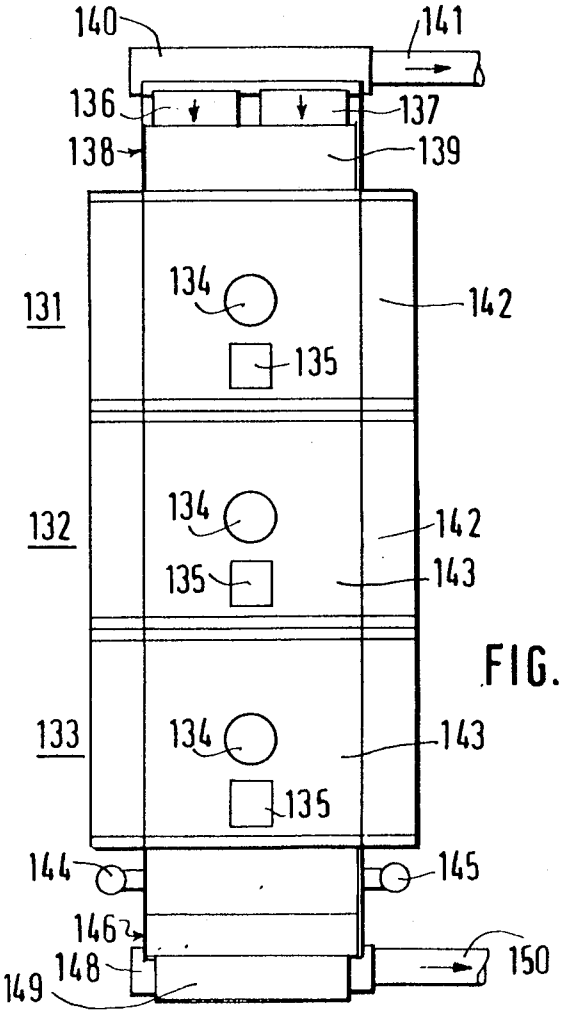
FIG. 15 is a top view of a multi-tier refrigeration tunnel, of modular construction, with lateral doors and with top-mounted fan motors, and with the above shown embodiments of the present invention.

FIG. 15 represents schematically the top view of a modular, linear, three-tier refrigeration tunnel with two product conveyor belts on each tier as described in the preceding embodiments of the invention. The represented refrigeration tunnel consists of three assembled modular sections 131, 132, and 133, one product entry vestibule 138, and one product exit vestibule 146. The modular sections 131, 132, and 133 have upper 142 and lower (not shown) lateral doors that are hinged, respectively, to the ceiling 143 and the bottom (not shown) of the modular sections. The temperature of the atmosphere contained in the insulated enclosure defined by the modular sections 131, 132, 133 and by the product entry vestibule 138 and the product exit vestibule 146 is maintained at subzero levels by the injection through suitable apparatus, such as nozzles, of a suitable liquid cryogen, such as carbon dioxide or nitrogen. The supply of the cryogen is controlled by temperature regulators (not shown) and by solenoid valves or other suitable flow control means located in the cold boxes 135 located over the ceiling 143 of the insulated modular sections 131, 132, 133. The gaseous phase of the liquid cryogen is exhausted from the insulated enclosure after the latent heat of the change from the condensed to the gaseous phase of the liquid cryogen has been utilized and, when applicable, after some of the sensible heat of the gaseous phase of the liquid cryogen has been utilized. The exhaust is performed through suitable means such as exhaust troughs 140 and 148, exhaust ducts 141 and 150, and exhaust blowers (not shown) downstream of the exhaust ducts 141 and 150. Circulation of the cold gas atmosphere within the insulated enclosure is achieved by horizontal propellers of suitable characteristics driven by top-mounted fan motors 134 (here one fan motor per module). The product to be refrigerated is loaded on the left-hand side conveyor belt 137 and on the right-hand side conveyor belt 136 of the top tier, and the conveyor belts carry the products into the insulated enclosure and below the product loading zone cover 139. The products are transferred from the upper tier to the middle tier at a location close to the product exit vestibule 146 and are transferred from the middle tier to the bottom tier at a location close to the product entry vestibule 138. The transfer process occurs in the manner described previously (i.e., with gable shaped product guards at the transfer zones). The products are then discharged from the insulated enclosure through the product discharge plate 149 located above the exhaust trough 148. Some multi-tier linear refrigeration tunnels, such as the one represented in FIG. 15, are equipped with a conveyor drive motor 145 dedicated to the upper tier conveyor belts 136 and 137 and with a second conveyor drive motor 144 dedicated to the lower tier conveyor belts (not shown). The two conveyor drive motors 144, 145 allow for different speeds of the upper tier and the lower tier conveyor belts.

Figure 16:
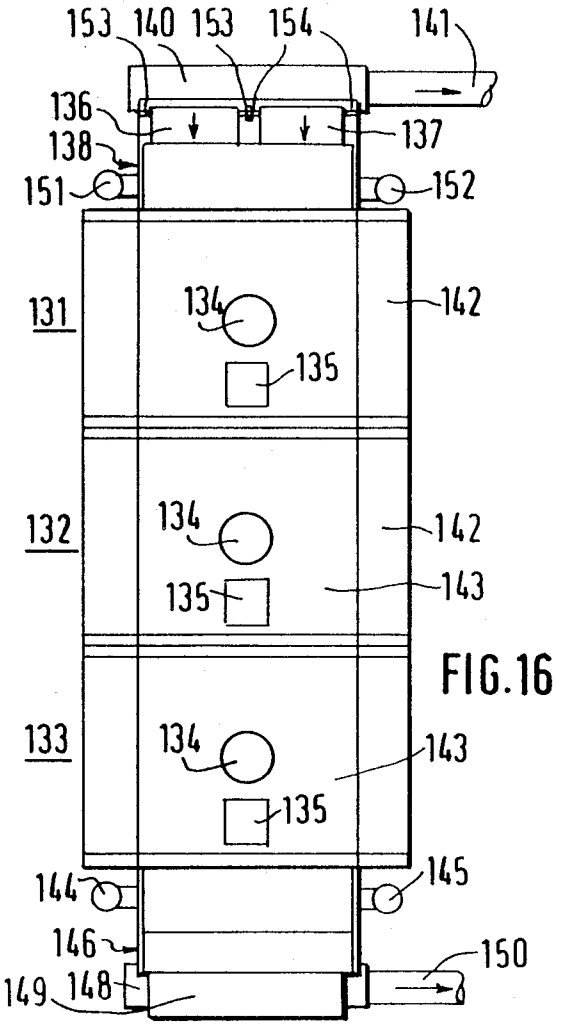
FIG. 16 is a top view of a multi-tier refrigeration tunnel, of modular construction, with lateral doors, with top-mounted fan motors and with the above listed embodiments of the invention, according to a fourth embodiment of the present invention. In this embodiment additional conveyor drives are provided, thereby allowing for separate speed controls of the left-hand side and the right-hand side conveyor belts and thereby allowing for processing two different products of different required dwell times within the same refrigeration equipment.

FIG. 16 represents still another embodiment of the present invention in which the left-hand side conveyor belt 137 of the upper tier is driven by a conveyor drive motor 145, the right-hand side conveyor belt 136 of the upper tier is driven by a conveyor drive motor 144, the left-hand side conveyor belts of the lower tiers are driven by a conveyor drive motor 152, and the right-hand side conveyor belts of the lower tiers are driven by a conveyor drive motor 151. The left-hand side and right-hand side conveyor belts have independent drive and return shafts, such as a return shaft 153 for the right-hand side conveyor belt 136 of the top tier and a return shaft 154 for the left-hand side conveyor belt 137 of the top tier. The shafts 153, 154 are located on the same axis. The above described option of separate drives for left-hand side conveyor belts and right-hand side conveyor belts enables processing simultaneously and within one such multi-tier refrigeration tunnel two products of different required dwell times (to achieve desired refrigeration effects), the first product being transported by the left-hand side conveyor belts and the second product being transported by the right-hand side conveyor belts.

Figure 17:
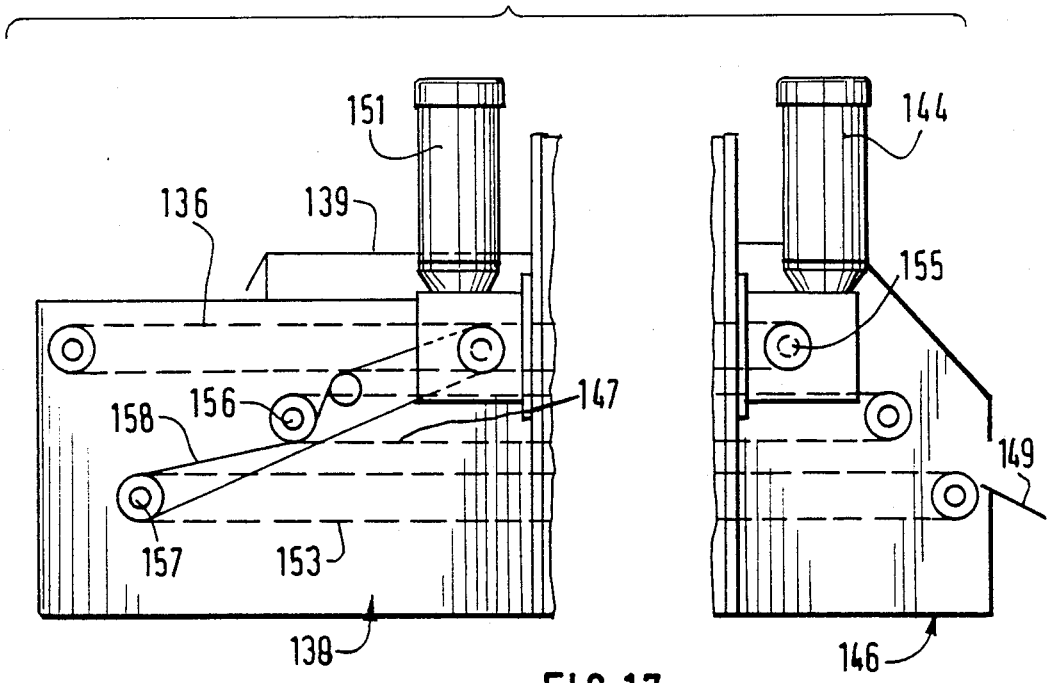
FIG. 17 is a side cross sectional view of the multi-tier refrigeration tunnel as shown in FIG. 16. The side view shows the product loading vestibule and the product unloading vestibule. The product loading vestibule supports the drive motors for the left-hand side and the right-hand side conveyor belts of the lower tiers, and the product unloading vestibule supports the drive motors for the left-hand side and the right-hand side conveyor belts of the upper tier.

FIG. 17 represents a further embodiment of the present invention as shown in FIG. 16, wherein the means to separately drive the right-hand side conveyor belts from the left-hand side conveyor belts and the means to separately drive the upper conveyor belts from the lower conveyor belts are represented. Represented in FIG. 17 is the left-hand side of the tunnel, and more specifically the product entry vestibule 138 and the product exit vestibule 146, both as depicted in FIG. 16. The left-hand side of the tunnel is a symmetrical image of the right-hand side illustrated in FIG. 17. The upper tier right-hand side conveyor belt 136 is driven by a drive shaft 155, and the drive shaft 155 is driven directly by the conveyor drive motor 144 mounted on the product exit vestibule 146. The middle tier right-hand side conveyor belt 147 is driven (actually, pulled) by a drive shaft 156. The drive shaft 156 is driven by a chain 158, and the chain 158 is driven by the conveyor drive motor 151 mounted on the product entry vestibule 138. The bottom tier right-hand side endless product conveyor belt is driven (actually, pushed) by a drive shaft 157. The drive shaft 157 is also driven by the chain 158 and the drive motor 151.

Figure 18:
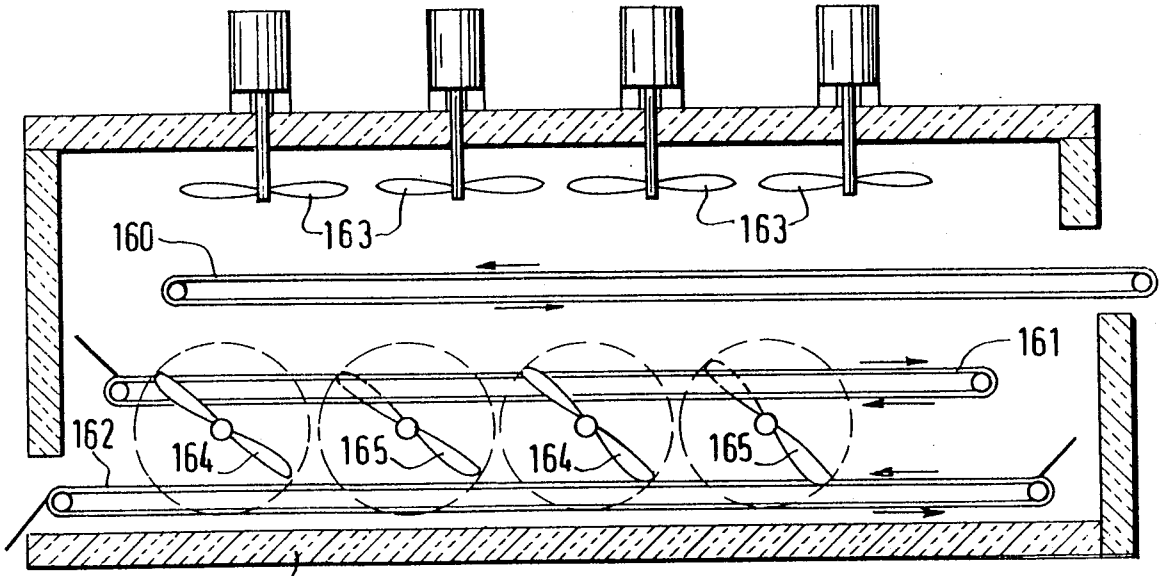
FIG. 18 is a side cross sectional view of a multi-tier refrigeration tunnel, not of modular construction and without lateral doors, according to a fifth embodiment (not a preferred embodiment when based on potential production capacity increase, but a preferred embodiment when based on construction and manufacture simplicity) of the present invention, showing the combined use of top-mounted fan propellers dedicated to the heat transfer process on the upper tier and of side-mounted fan propellers dedicated to the heat transfer process on the lower tiers.
Figure 18A:
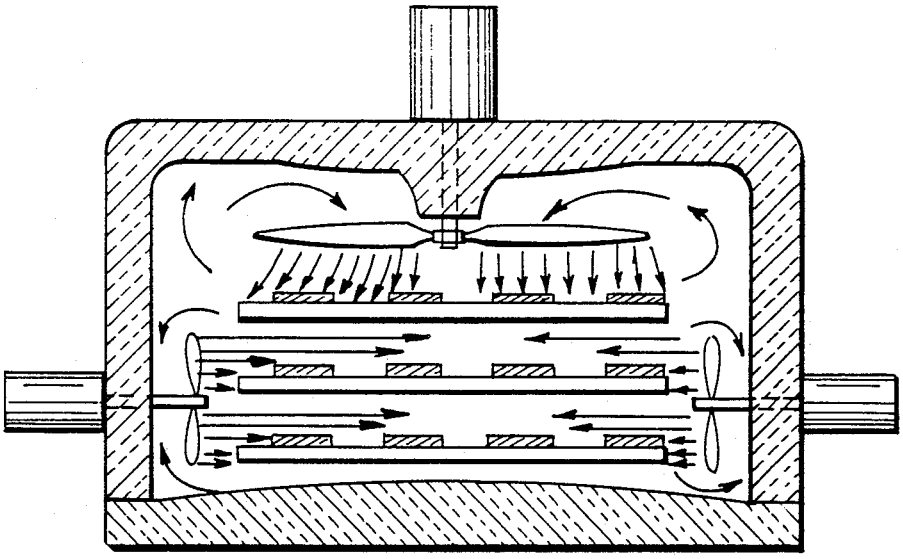
FIG. 18*a* is a cross sectional view of the tunnel as shown in FIG. 18 showing the cold gas flow patterns within the enclosure of the tunnel.
Figure 19A:
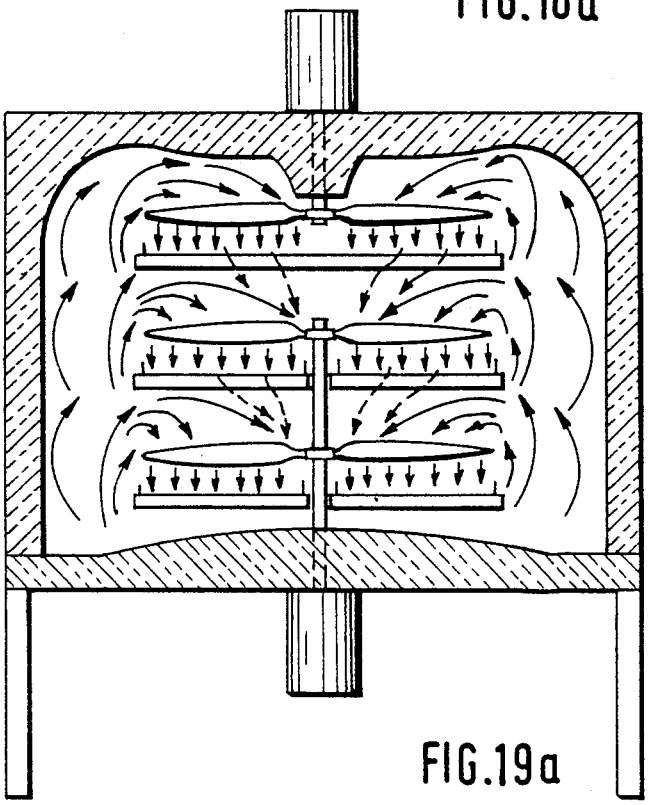
FIG. 19*a* is a cross sectional view of the tunnel as shown in FIG. 19 showing the cold gas flow patterns within the enclosure of the tunnel.

FIG. 18 represents a different embodiment of the present invention. This embodiment is more specific to multi-tier refrigeration tunnels of the type shown in FIG. 1 (where access to the inner volume of the insulated enclosure is obtained by raising the ceiling of the equipment), while the embodiments previously described are specific to multi-tier refrigeration tunnels of the type shown in FIG. 4 (where access to the inner volume of the insulated enclosure is obtained by opening the lateral doors of the tunnel). FIG. 18 represents schematically the means to achieve satisfactory (although not optimum) flow characteristics of the cold gas over the lower tier 162 and the middle tier 161 of the tunnel while maintaining optimum flow characteristics for the cold gas over the upper tier 160. The flows are schematically represented in FIG. 18*a*. The means are comprised of the combination of top-side-mounted fan motors and horizontal propellers 163 and lateral-sides-mounted fan motors and vertical propellers 164 and 165. The characteristics of the horizontal propellers 163 and the corresponding motors are chosen according to the existing art in single-tier refrigeration tunnel technology and based on the requirement of maximum forced convection heat transfer coefficient without levitating the products transported by the conveyor belts. The characteristics of the vertical propellers 164 and 165 are chosen in a similar fashion. However, their diameters and the level of their shafts are functions of the geometry of the equipment, and more specifically of the distance between the product carrying portions of the belts of the middle tier 161 and of the bottom tier 162 and of the distance between the bottom tier 162 and the bottom of the tunnel. The shafts of the vertical propellers should be located below the middle tier 161 and slightly above the middle point between the product carrying portions of the belts of the middle tier 161 and of the lower tier 162. The diameter of the vertical propellers 164, 165 should be no less than 125% of the distance between the middle tier 161 and the lower tier 162, and as large as possible, but no more than the distance between the upper tier 160 and the shaft of the propeller. Optimum propeller diameters and shaft locations correspond to identical and highest possible values for the chord area obtained from the intersection of the circular surface described by the propeller fans with the surfaces defined by a horizontal line one inch above the middle tier 161 and the bottom tier 162 and by the product carrying portions of the belts of the tiers 161 and 162, respectively. Consequently, the shafts of the vertical propellers must be positioned one half inch above the line of equidistance between the product carrying portions of the conveyor belts of the middle tier 161 and of the lower tier 162, respectively, and the radius of the propellers is the lesser of the distance between the shaft location and either the upper tier 160 or the bottom 166 of the tunnel.

Figure 20:
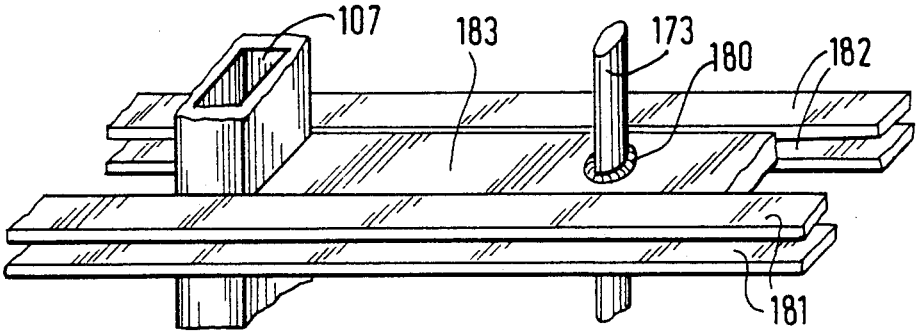
FIG. 20 is an overall view of a portion of the conveyor belts support frame according to the present invention, showing the extension of the support frame as shown in FIG. 12 in order to be used in the equipment design as shown in FIG. 19. This extension allows the designer to center and guide the bottom fan shafts as shown in FIG. 19.
Figure 19:
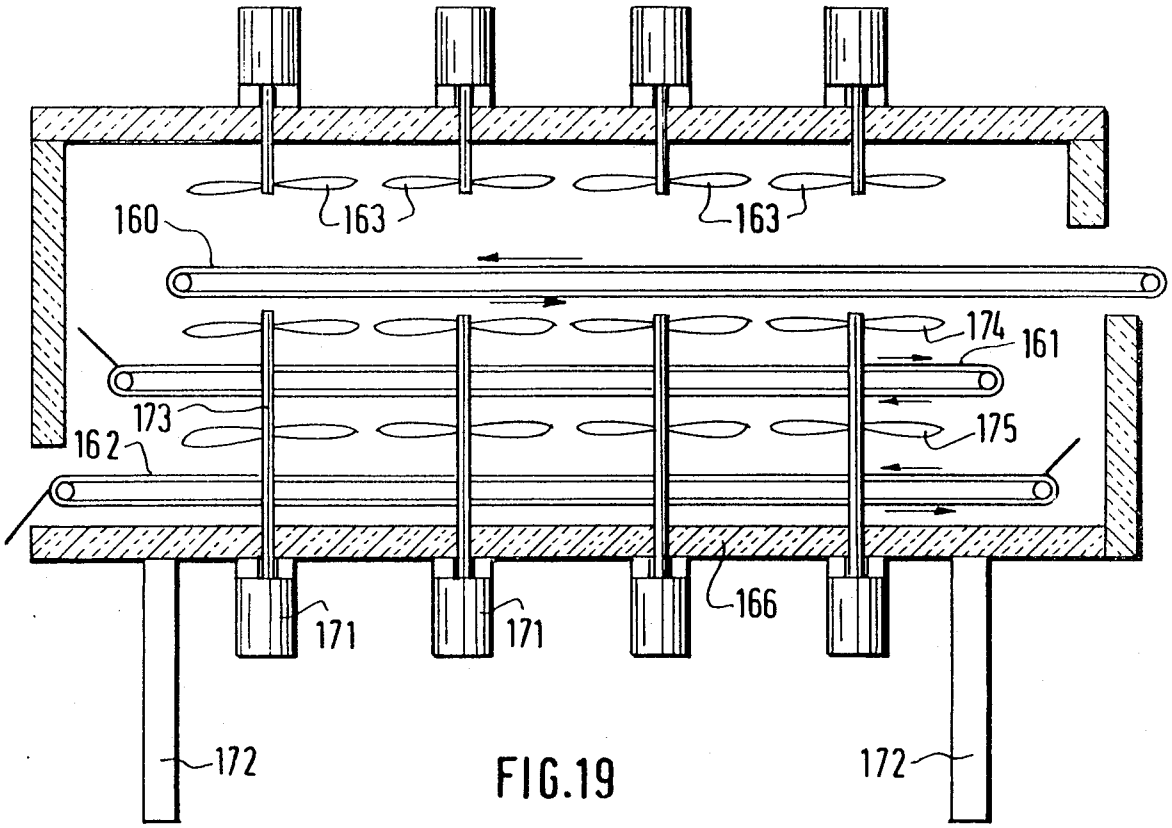
FIG. 19 is a cross sectional view of a multi-tier refrigeration tunnel, not of modular construction and without lateral doors, according to a sixth and preferred (for refrigeration tunnels of non modular construction and without lateral doors) embodiment of the present invention, showing the combined use of top-mounted fan propellers dedicated to the heat transfer process on the upper tier and of bottom-mounted fan propellers dedicated to the heat transfer process on the lower tiers.

FIG. 19 represents still another embodiment of the present invention. This invention is applicable to all types of construction of multi-tier refrigeration tunnels, be it modular or not and be it with lateral doors or without. However, because this embodiment requires a larger number of fan motors compared to the design illustrated in FIGS. 7–11, which design requires that the tunnel be fitted with lateral doors, the embodiment illustrated in FIG. 19 is specific to multi-tier refrigeration tunnels without lateral doors. This embodiment requires that the bottom 166 of the insulated enclosure does not rest on the floor, but is raised and supported by legs 172, which is typically the case. This embodiment uses the type of frame shown in FIG. 12, FIG. 13, and FIG. 14. This frame allows use of two separate and parallel conveyor belts with a gap between the separate belts, the gap being of suitable dimensions on all tiers, but more specifically on the middle tier 161 and on the bottom tier 162. The gaps allow the mounting of vertical shafts 173 driven by bottom side mounted fan motors 171. Horizontal propellers 174 and 175 of suitable dimensions, typically of the same dimensions as the horizontal propellers 163, are mounted on the vertical shafts 173 above, respectively, the middle tier 161 and the bottom tier 162. The vertical shaft 173 is of suitable material and dimensions to avoid oscillations, since, contrary to the previous embodiments of the invention (i.e., the embodiments illustrated by FIGS. 7, 8, 9, 10, and 11), the shafts 173 have a free end. Alternatively, the rotation of the shafts 173 can be centered through suitable means such as bearings mounted on extensions to the modular frame illustrated in FIG. 12, and more specifically on horizontal extensions to the support tubes 107 (FIG. 12), the extensions being on the same plane as the middle tier 161. The bearing 180 location is represented in FIG. 20, where 107 represents the frame support tubes as described with reference to FIG. 12. Where 181 represents the support rails for the inner edges of the left-hand side conveyor belts of the middle tier, while 182 represents the support rails for the inner edges of the right-hand side conveyor belts 147 of the middle tier, while 173 represents the vertical shaft as defined with reference to FIG. 19, and where 183 represents the above mentioned horizontal extension to the frame between the support tubes 107.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by letters patent of the U.S. is:

1. A multi-tier refrigeration tunnel comprising:

(a) an insulated enclosure;

(b) two parallel, spaced first conveyor belts located in said insulated enclosure and on which, in use, products to be refrigerated are conveyed in a first direction;

(c) two parallel, spaced second conveyor belts located in said insulated enclosure and on which, in use, products to be refrigerated are conveyed in a second direction opposite to said first direction, each one of said two parallel, spaced second conveyor belts being located beneath a corresponding one of said two parallel, spaced first conveyor belts;

(d) two parallel, spaced third conveyor belts located in said insulated enclosure and on which, in use, products to be refrigerated are conveyed in said first direction, each one of said two parallel, spaced third conveyor belts being located beneath a corresponding one of said two parallel, spaced second conveyor belts;

(e) a plurality of vertical shafts each one of which extends between said two parallel, spaced first conveyor belts and said two parallel, spaced second conveyor belts;

(f) a first fan propeller mounted on each one of said plurality of vertical shafts above said two parallel, spaced first conveyor belts;

(g) a second fan propeller mounted on each one of said plurality of vertical shafts above said two parallel, spaced second conveyor belts and beneath said two parallel, spaced first conveyor belts;

(h) a third fan propeller mounted on each one of said plurality of vertical shafts above said two parallel, spaced third conveyor belts and beneath said two parallel, spaced second conveyor belts; and (i) first means for rotating said plurality of shafts.

2. A multi-tier refrigeration tunnel as recited in claim 1 wherein:

(a) said two parallel, spaced first conveyor belts, said two parallel, spaced second conveyor belts, and said two parallel, spaced third conveyor belts all have the same width;

(b) said first, second, and third fan propellers provide a uniform product clearance; and (c) said first, second, and third fan propellers are provided with a head space height sufficient to avoid cavitation of said first, second, and third fan propellers.

3. A multi-tier refrigeration tunnel as recited in claim 2 wherein said first means comprises a plurality of fan motors, each one of said plurality of fan motors being mounted on the outside of said top panel and being operatively connected to a corresponding one of said plurality of vertical shafts.

4. A multi-tier refrigeration tunnel as recited in claim 1 wherein:

(a) said insulated enclosure comprises an insulated top panel located above said first fan propeller and an insulated bottom panel located beneath said two parallel, spaced third conveyor belts;

(b) each one of said vertical shafts extends between said two parallel, spaced third conveyor belts and is journalled in said insulated bottom panel; and (c) said first means comprises at least one fan motor mounted on the outside of said top panel and operatively connected to one of said plurality of vertical shafts.

5. A multi-tier refrigeration tunnel as recited in claim 4 wherein:

(a) said multi-tier refrigeration tunnel further comprises a plurality of first bearings located within the space between said two parallel, spaced second conveyor belts;

(b) each one of said plurality of vertical shafts is journalled in a corresponding one of said plurality of first bearings; and (c) the rotation of each one of said vertical shafts is guided by the corresponding one of said plurality of first bearings.

6. A multi-tier refrigeration tunnel as recited in claim 5 wherein:

(a) said multi-tier refrigeration tunnel further comprises a plurality of second bearings located within the space between said two parallel, spaced third conveyor belts;

(b) each one of said plurality of vertical shafts is journalled in a corresponding one of said plurality of second bearings; and (c) the rotation of each one of said vertical shafts is guided by the corresponding one of said plurality of second bearings.

7. A multi-tier refrigeration tunnel as recited in claim 3 wherein said plurality of fan motors are wired to a variable speed controller, whereby the rotation speed of said fan propellers can be set just below the level that blows the products off said conveyor belts.

8. A multi-tier refrigeration tunnel as recited in claim 1 and further comprising:

(a) a plurality of first cryogenic injection orifices located above said two parallel, spaced first conveyor belts;

(b) a plurality of second cryogenic injection orifices located above said two parallel, spaced second conveyor belts and beneath said two parallel, spaced first conveyor belts; and (c) a plurality of third cryogenic injection orifices located above said two parallel, spaced third conveyor belts and beneath said two parallel, spaced second conveyor belts.

9. A multi-tier refrigeration tunnel as recited in claim 8 and further comprising a plurality of temperature sensors, temperature controllers, and cryogen flow controllers each one of which corresponds to one of a plurality of zones of cryogenic injection orifices.

10. A multi-tier refrigeration tunnel as recited in claim 8 wherein said plurality of first, second, and third cryogenic injection orifices are each:

(a) distributed uniformly across the width of the corresponding one said two parallel, spaced first, second, and third conveyor belts;

(b) directed such that the expansion jets from said cryogenic injection orifices are directed towards the products conveyed by said conveyor belts, thereby further enhancing the refrigeration imparted on the upper surface and on a portion of the lateral surfaces of said products; and (c) providing selected injection surfacic coverage density on said conveyor belts.

11. A multi-tier refrigeration tunnel as recited in claim 1 and further comprising side product guides on each side of each one of said two parallel, spaced, first, second, and third conveyor belts.

12. A multi-tier refrigeration tunnel as recited in claim 1 wherein each one of said two parallel, spaced, first, second, and third conveyor belts is a mesh conveyor belt.

13. A multi-tier refrigeration tunnel as recited in claim 1 wherein:

(a) said multi-tier refrigeration tunnel further comprises a plurality of edge rails;

(b) each edge of the product carrying portion and each edge of the return portion of each one of said two parallel, spaced, first, second, and third conveyor belts is supported and guided by one of said plurality of edge rails; and (c) each one of said plurality of edge rails is covered by a layer of synthetic low friction material.

14. A multi-tier refrigeration tunnel as recited in claim 1 wherein a product guide in the shape of a gable is disposed over the space between said two parallel, spaced first conveyor belts at the upstream end of their working runs and at least over part of the length of the product loading zone.

15. A multi-tier refrigeration tunnel as recited in claim 1 wherein a product guide in the shape of a gable is disposed over the space between said two parallel, spaced second conveyor belts at the upstream end of their working runs.

16. A multi-tier refrigeration tunnel as recited in claim 1 wherein a product guide in the shape of a gable is disposed over the space between said two parallel, spaced third conveyor belts at the upstream end of their working runs.

17. A multi-tier refrigeration tunnel as recited in claim 1 wherein said multi-tier refrigeration tunnel is modular in form, comprising a plurality of modular sections engageable with and disengageable from each other in the horizontal direction defined by the length axis of said multi-tier refrigeration tunnel.

18. A multi-tier refrigeration tunnel as recited in claim 17 wherein each of said plurality of modular sections comprises:

(a) an insulated bottom panel of said insulated enclosure;

(b) an insulated top panel of said insulated enclosure, said insulated top panel being stationary with respect to said insulated bottom panel; and (c) lateral insulated panels between said insulated bottom panel and said insulated top panel which are removable, thereby allowing access to the inner volume of said modular section for cleaning, inspection, and maintenance purposes.

19. A multi-tier refrigeration tunnel as recited in claim 1 and further comprising a product entry vestibule located at the upstream end of said two parallel, spaced first conveyor belts.

20. A multi-tier refrigeration tunnel as recited in claim 1 and further comprising a product exit vestibule located at the downstream end of said two parallel, spaced third conveyor belts.

21. A multi-tier refrigeration tunnel as recited in claim 1 and further comprising second means for driving one said two parallel, spaced first, second, and third conveyor belts at a different speed than another one of said two parallel, spaced first, second, and third conveyor belts.

22. A multi-tier refrigeration tunnel as recited in claim 1 and further comprising second means for driving said two parallel, spaced first conveyor belts at a different speed than said two parallel, spaced second conveyor belts and said two parallel, spaced third conveyor belts.

23. A multi-tier refrigeration tunnel as recited in claim 1 and further comprising third means for driving said conveyor belts on one side of said plurality of vertical shafts at a different speed than said conveyor belts on the other side of said plurality of vertical shafts, thereby allowing the simultaneous processing in said tunnel of two different types of products requiring different dwell times to achieve the required refrigeration amount.

24. A multi-tier refrigeration tunnel comprising:

(a) an insulated enclosure;

(b) a first conveyor belt located in said insulated enclosure and on which, in use, products to be refrigerated are conveyed in a first direction;

(c) a second conveyor belt located in said insulated enclosure and on which, in use, products to be refrigerated are conveyed in a second direction opposite to said first direction, said second conveyor belt being located beneath said first conveyor belt;

(d) a third conveyor belt located in said insulated enclosure and on which, in use, products to be refrigerated are conveyed in said first direction, said third conveyor belt being located beneath said second conveyor belt;

(e) a plurality of horizontally disposed fan propellers mounted above said first conveyor belt;

(f) first means for rotating said plurality of horizontally disposed fan propellers;

a plurality of at least substantially vertically disposed fan propellers mounted beside said second and third conveyor belts; and (h) second means for rotating said plurality of at least substantially vertically disposed fan propellers.

25. A multi-tier refrigeration tunnel as recited in claim 24 wherein:

(a) said insulated enclosure comprises an insulated top panel located above said plurality of horizontally disposed fan propellers and an insulated bottom panel located beneath said third conveyor belt and (b) said first means comprises:

(i) a plurality of vertical shafts, each one of said plurality of horizontally disposed fan propellers being mounted on a corresponding one of said plurality of vertical shafts, and (ii) at least one fan motor mounted on the outside of said top panel and operatively connected to one of said plurality of vertical shafts.

26. A multi-tier refrigeration tunnel as recited in claim 25 wherein said first means comprises a plurality of fan motors, each one of said plurality of fan motors being mounted on the outside of said top panel and being operatively connected to a corresponding one of said plurality of vertical shafts.

27. A multi-tier refrigeration tunnel as recited in claim 24 wherein:

(a) said multi-tier refrigeration tunnel further comprises two side panels and (b) said second means comprises:
(i) a plurality of at least substantially horizontal shafts, each one of said plurality of at least substantially vertically disposed fan propellers being mounted on a corresponding one of said plurality of at least substantially horizontal shafts, and
(ii) at least one fan motor mounted on the outside of one of said side panels and operatively connected to one of said plurality of at least substantially horizontal shafts.

28. A multi-tier refrigeration tunnel as recited in claim 27 wherein said two side panels are insulated panels and are part of said insulated enclosure.

29. A multi-tier refrigeration tunnel as recited in claim 27 wherein said two side panels are contained within said insulated enclosure.

30. A multi-tier refrigeration tunnel as recited in claim 27 wherein said second means comprises a plurality of fan motors, each one of said plurality of fan motors being mounted on the outside of one of said side panels and being operatively connected to a corresponding one of said plurality of at least substantially horizontal shafts.

31. A multi-tier refrigeration tunnel as recited in claim 30 wherein some of said plurality of fan motors are mounted on the outside of one of said two side panels and others of said plurality of fan motors are mounted on the other of said two side panels.

32. A multi-tier refrigeration tunnel as recited in claim 24 wherein:
(a) the centers of rotation of said plurality of at least substantially vertically disposed fan propellers are:
(i) at least approximately ½ inch above the line of equidistance between the working runs of said second conveyor belt and said third conveyor belt and
(ii) below the working run of said second conveyor belt and
(b) the radius of each one of said plurality of at least substantially vertically disposed fan propellers is the lesser of:
(i) the distance between said centers of rotation and the non-working run of said first conveyor belt and
(ii) the distance between said centers of rotation and the inner surface of the bottom of said insulated enclosure.

33. A multi-tier refrigeration tunnel comprising:
(a) an insulated enclosure;
(b) at least one first conveyor belt located in said insulated enclosure and on which, in use, products to be refrigerated are conveyed in a first direction;
(c) a plurality of horizontally disposed first fan propellers mounted above and said at least one first conveyor belt;
(d) first means for rotating said plurality of horizontally disposed first fan propellers;
(e) two parallel, spaced second conveyor belts located in said insulated enclosure and on which, in use, products to be refrigerated are conveyed in a second direction opposite to said first direction, each one of said two parallel, spaced second conveyor belts being located beneath said at least one first conveyor belt;
(f) two parallel, spaced third conveyor belts located in said insulated enclosure and on which, in use, products to be refrigerated are conveyed in said first direction, each one of said two parallel, spaced third conveyor belts being located beneath a corresponding one of said two parallel, spaced second conveyor belts;
(g) a plurality of horizontally disposed second fan propellers mounted above said two parallel, spaced second conveyor belts and beneath said at least one first conveyor belt;
(h) a plurality of horizontally disposed third fan propellers mounted above said two parallel, spaced third conveyor belts and beneath said two parallel spaced, second conveyor belts;
(i) a plurality of vertical shafts each one of which extends between said two parallel, spaced second conveyor belts and said two parallel, spaced third conveyor belts;
(j) a second fan propeller mounted on each one of said plurality of vertical shafts above said two parallel, spaced second conveyor belts and beneath said at least one first conveyor belt;
(k) a third fan propeller mounted on each one of said plurality of vertical shafts above said two parallel, spaced third conveyor belts and beneath said two parallel, spaced second conveyor belts; and
(l) second means for rotating said plurality of vertical shafts.

34. A multi-tier refrigeration tunnel as recited in claim 33 wherein:
(a) said multi-tier refrigeration tunnel further comprises a top panel located above said first fan propellers and a bottom panel located beneath said two parallel, spaced third conveyor belts and
(b) said second means comprises at least one fan motor mounted on the outside of said bottom panel and operatively connected to one of said plurality of vertical shafts.

35. A multi-tier refrigeration tunnel as recited in claim 34 wherein said second means comprises a plurality of fan motors, each one of said plurality of fan motors being mounted on the outside of said bottom panel and being operatively connected to a corresponding one of said plurality of vertical shafts.

* * * * *